US007167148B2

(12) United States Patent
Richards

(10) Patent No.: US 7,167,148 B2
(45) Date of Patent: Jan. 23, 2007

(54) DATA PROCESSING METHODS AND APPARATUS IN DIGITAL DISPLAY SYSTEMS

(75) Inventor: Peter W. Richards, Menlo Park, CA (US)

(73) Assignee: Texas Instruments Incorporated, Dallas, TX (US)

( * ) Notice: Subject to any disclaimer, the term of this patent is extended or adjusted under 35 U.S.C. 154(b) by 398 days.

(21) Appl. No.: 10/648,608

(22) Filed: Aug. 25, 2003

(65) Prior Publication Data

US 2005/0057463 A1 Mar. 17, 2005

(51) Int. Cl.
*G09G 3/36* (2006.01)

(52) U.S. Cl. ..... 345/84; 345/90; 345/98; 345/99; 345/100; 345/603; 359/290; 359/291

(58) Field of Classification Search ..... 345/48, 345/84, 90, 98, 99, 100, 603; 348/755, 770, 348/771; 359/290, 291
See application file for complete search history.

(56) References Cited

U.S. PATENT DOCUMENTS

| | | | | |
|---|---|---|---|---|
| 4,006,298 | A | 2/1977 | Fowler et al. | |
| 4,648,077 | A | 3/1987 | Pinkham et al. | |
| 4,748,510 | A | 5/1988 | Umezawa | |
| 4,908,710 | A | 3/1990 | Wakai et al. | |
| 4,998,167 | A | 3/1991 | Jaqua | |
| 5,029,326 | A | 7/1991 | Tabata | |
| 5,068,904 | A | 11/1991 | Yamazaki | |
| 5,079,544 | A | 1/1992 | DeMond et al. | |
| 5,111,192 | A | 5/1992 | Kadakia | |
| 5,227,882 | A | 7/1993 | Kato | |
| 5,254,980 | A | 10/1993 | Hendrix et al. | |
| 5,255,100 | A | 10/1993 | Urbanus | |
| 5,278,652 | A | 1/1994 | Urbanus et al. | |
| 5,339,116 | A | 8/1994 | Urbanus et al. | |
| 5,361,339 | A | 11/1994 | Kadakis et al. | |
| 5,373,323 | A | 12/1994 | Kwon | |
| 5,442,458 | A * | 8/1995 | Rabbani et al. | 382/247 |
| 5,452,024 | A | 9/1995 | Sampsell | |
| 5,548,301 | A | 8/1996 | Kornher et al. | |
| 5,663,749 | A | 9/1997 | Farris et al. | |
| 6,201,521 | B1 * | 3/2001 | Doherty | 345/84 |
| 6,774,916 | B2 * | 8/2004 | Pettitt et al. | 345/691 |
| 6,798,941 | B2 * | 9/2004 | Smith et al. | 385/18 |
| 2002/0016629 | A1 * | 2/2002 | Sandstedt et al. | 623/6.11 |
| 2002/0036611 | A1 * | 3/2002 | Ishii | 345/89 |
| 2002/0080672 | A1 * | 6/2002 | Lee et al. | 365/221 |
| 2003/0081132 | A1 * | 5/2003 | Kuno et al. | 348/222.1 |
| 2003/0107539 | A1 * | 6/2003 | Wood | 345/87 |
| 2003/0197669 | A1 * | 10/2003 | Marshall | 345/87 |
| 2003/0227677 | A1 * | 12/2003 | Doherty et al. | 359/449 |

* cited by examiner

*Primary Examiner*—Bipin Shalwala
*Assistant Examiner*—Vincent E. Kovalick
(74) *Attorney, Agent, or Firm*—W. James Brady, III; Frederick J. Telecky, Jr.

(57) ABSTRACT

Data processing methods and apparatus used in digital display system transpose pixel-by-pixel data into bitplane-by-bitplane data. The methods and apparatus are especially useful for dynamically transposing high-speed flowing-through pixel data in a "real-time" fashion. In a transpose process, a stream of pixel data is received by a plurality of input lines of the transpose apparatus. The received pixel data are delayed by a set of delay units and then permutated by one or more switches according to a predefined delay scheme and permutation rule. After permutation, the stream of data is delayed so as to finalize the transpose process.

60 Claims, 9 Drawing Sheets

Pixel data

Bit-plane data

Barrel Shifter

DATA PROCESSING METHODS AND APPARATUS IN DIGITAL DISPLAY SYSTEMS

TECHNICAL FIELD OF THE INVENTION

The present invention is related generally to the art of digital display systems using spatial light modulators such as micromirror arrays or ferroelectric LCD arrays, and more particularly, to a method and an apparatus for converting a stream of image data from a pixel-by-pixel format into bitplane-by-bitplane format.

BACKGROUND OF THE INVENTION

In current digital display systems using micromirror arrays or other similar spatial light modulators such as ferroelectric LCDs, each pixel of the array is individually addressable and switchable between an ON state and an OFF state. In the ON state, the micromirror reflects incident light so as to generate a "bright" pixel on a display target. In the OFF state, the micromirror reflects the incident light so as to generate a "dark" pixel on the display target. Grayscale images can be created by turning the micromirror on and off at a rate faster than the human eye can perceive, such that the pixel appears to have an intermediate intensity proportional to the fraction of the time when the micromirror is on. This method is generally referred to as pulse-width-modulation (PWM). Full-color images may be created by using the PWM method on separate SLMs for each primary color, or by a single SLM using a field-sequential color method.

For addressing and turning the micromirror on or off, each micromirror may be associated with a memory cell circuit that stores a bit of data that determines the ON or OFF state of the micromirror. In order to achieve various levels of perceived light intensity by human eyes using PWM, each pixel of a grayscale image is represented by a plurality of data bits. Each data bit is assigned a significance. Each time the micromirror is addressed, the value of the data bit determines whether the addressed micromirror is on or off. The bit significance determines the duration of the micromirror's on or off period. The bits of the same significance from all pixels of the image are called a bitplane. If the elapsed time the micromirrors are left in the state corresponding to each bitplane is proportional to the relative bitplane significance, the micromirrors produce the desired grayscale image.

In practice, the memory cells associated with the micromirror array are loaded with a bitplane at each designated addressing time. During a frame period, a number of bitplanes are loaded into the memory cells for producing the grayscale image; wherein the number of bitplanes equals the predetermined number of data bits representing the image pixel.

The bitplane-by-bitplane formatted image data (hereafter, bitplane data), however, are not immediately available from peripheral image sources, such as a video camera, DVD/VCD player, TV/HDTV tuner, or PC video card, because the outputs (thus the input for the memory cells) of the image sources are usually either pixel-by-pixel formatted data (hereafter, pixel data), in which all bits of a single pixel are presented simultaneously, or standard analog signals that are digitized and transformed into pixel data. Pixel data is typically provided as a set of parallel signals, each of which carries a bit of different significance. All bits of a particular pixel are presented simultaneously across the set of signals. Successive pixels in the image are presented sequentially in time, typically synchronized with a pixel clock which is either provided by the image source or derived from other timing signals provided by the image source (such as horizontal- and vertical-sync signals). The pixel-by-pixel data format for the stream of video data is natural for non-PWM display technologies such as CRTs or analog LCDs, and has become the standard format for video data due to the historical dominance of these technologies. In order for PWM-based digital displays to interface with pixel-by-pixel formatted image sources, it is necessary to reformat the incoming video data (e.g. the pixel data) such that the bitplanes of the image can be stored and retrieved efficiently.

Therefore, methods and apparatus are desired for transforming a stream of pixel data into bitplane data.

SUMMARY OF THE INVENTION

In view of the foregoing, the present invention provides a method and apparatus of converting a stream of pixel data in space and time into a stream of bitplane data. The apparatus of the present invention receives the pixel data in a "real-time" fashion, and dynamically performs predefined permutations so as to accomplish the predefined transpose operation. In another embodiment of the invention, the pixel data are stored in a storage medium, and the apparatus of the present invention retrieves the pixel data and performs the predefined permutation to accomplish the predefined transpose operation. The methods and apparatus disclosed herein are especially useful for processing a high-speed stream of digital data in a flow-through manner and suitable for implementation in a hardware video pipeline. The control signal fanout and gate count of this invention are reduced compared to currently available similar techniques for converting pixel data into bitplane data.

In an embodiment of the invention, a method is disclosed. The method is used in a display system that comprises an array of micromirrors, each micromirror being associated with a memory cell of a memory cell array, to produce images. The method comprises: loading a pixel data matrix of the image, the pixel data matrix following a pixel data format, wherein matrix elements in one column of the matrix represent one pixel of the image; delivering the rows of the matrix in parallel into a data converter; transposing, by the data converter, the pixel data matrix into a bitplane matrix following a bitplane format wherein matrix elements in one row of the matrix represent one pixel of the image; and sending the bitplane matrix into the memory cell array for actuating the micromirrors such that the image is produced by the micromirrors.

In another embodiment of the invention, a method is disclosed. The method is used in a display system that comprises an array of micromirrors, each micromirror being associated with a memory cell of a memory cell array, to produce images. The method comprises: delivering an input pixel data matrix having m columns and n rows of the image to a data converter such that the rows of the pixel data matrix are delivered in parallel into the data converter, and the columns are delivered to the data converter sequentially at a series of time-units; delaying the data elements of the input matrix such that the pixel data at column i and row j (where $1<=i<=m$ and $1<=j<=n$) is delayed $j-1$ time-units relative to the data at column i and row 1; shifting the delayed data elements at each time-unit of the sequence of time-units according to a shifting rule, wherein the shifting rule states that: a) the data element of row j at the $k^{th}$ time-unit of the time-unit sequence is shifted to row $((n+j-k-1) \bmod k)+1$ at the same time-unit; wherein k runs from 1 to m+n time-units; and delaying the shifted data elements according to the sequence of time-units such that a data element of row j is delayed n−j time-units relative to the data element of row n.

In yet another embodiment of the invention, a method is disclosed. The method is used in a display system that comprises an array of micromirrors, each micromirror being associated with a memory cell of a memory cell array, to produce images. And the method comprises: delivering a pixel data matrix of the image to a data converter such that the rows of the pixel data matrix are delivered in parallel into the data converter, wherein the pixel data matrix follows a pixel data format; transforming the pixel data matrix into a block matrix having 2×2 first order blocks, each first order block having 2×2 second order blocks, each second order block having 2×2 third order blocks, each $k^{th}$ order block having 2×2 $(k+1)^{th}$ order blocks, and the $(n-1)^{th}$ order block having 2×2 pixel data elements; transposing the pixel data matrix based on the $(n-1)^{th}$ order blocks, each of which has 2×2 pixel data elements; transposing the pixel data matrix based on the $k^{th}$ order blocks after consecutive transposes of the pixel data matrix based on the $(n-1)^{th}$ order block through the $(k+1)^{th}$ order blocks; and transposing the pixel data matrix based on the first order blocks.

In yet another embodiment of the invention, an apparatus is provided. The apparatus is used in a display system that comprises an array of micromirrors, each micromirror being associated with a memory cell of a memory cell array to produce images. The apparatus comprises: a plurality of n input lines that are associated with a sequence of time-units, each input line being designated for receiving a row of data elements of a pixel data matrix; a delay unit connected to the plurality of input lines, wherein the delay unit delays each line of received data such that: a) the data element at input line j is delayed one time-unit relative to the data element at input line j−1; b) a shifter connected to and receiving output data from the delay unit, wherein the shifter shifts the delayed data output from the first delay unit based on the sequence of time-units and according to a shifting rule, wherein the shifting rule states that: the data element of line j at the $k^{th}$ time-unit is shifted to line ((n+j−k−1) mod k)+1 at the same time-unit; wherein k runs from 1 to m+n time-units.

In yet another embodiment of the invention, an apparatus is provided. The apparatus is used in a display system that comprises an array of micromirrors, each micromirror being associated a memory cell of a memory cell array to produce images. The apparatus comprises: a plurality of input lines that are associated with a sequence of time-units, each input line being designated for receiving a row of data elements of a pixel data matrix having m columns and n rows; a multiplicity of sets of delay units, a) wherein a delay unit of the first set of delay units delays a data element one time-unit, and the delay units of the first set are connected to every two input lines, and b) wherein a delay unit of the $s^{th}$ set of delay unit delays a data $2^{s-l}$ time-units, and the delay units of the $s^{th}$ set are connected to every $2^{s}-1$ input lines; a plurality of sets of switches, a) wherein a switch of the first set of switches exchanges data elements between input lines 2s−1 and 2*s* with s running from 1 to n/2; and b) wherein a switch of the $s^{th}$ set of switches exchanges or passes through data elements between w and $w+2^{s-1}$, where $1<=w<=2^{s-1}$; and wherein each switch of the $s^{th}$ set of switches are located between and connected to two delay units of the $s^{th}$ set of delay units.

BRIEF DESCRIPTION OF DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE EMBODIMENTS

Embodiments of the present invention can be implemented in a variety of ways and display systems. In the following, embodiments of the present invention will be discussed in a display system that employs a micromirror array and a pulse-width-modulation technique, wherein individual micromirrors of the micromirror array are controlled by memory cells of a memory cell array. It will be understood by those skilled in the art that the embodiments of the present invention are applicable to any grayscale or color pulse-width-modulation methods or apparatus, such as those described in U.S. Pat. No. 6,388,661, and U.S. patent application Ser. No. 10/340,162, filed Jan. 10, 2003, both to Richards, the subject matter of each being incorporated herein by reference. Each memory cell of the memory cell array can be a standard 1T1C (one transistor and one capacitor) circuit. Alternatively, each memory cell can be a "charge-pump-memory cell" as set forth in U.S. patent application Ser. No. 10/340,162 filed Jan. 10, 2003 to Richards, the subject matter being incorporated herein by reference. A charge-pump-memory-cell comprises a transistor having a source, a gate, and a drain; a storage capacitor having a first plate and a second plate; and wherein the source of said transistor is connected to a bitline, the gate of said transistor is connected to a wordline, and wherein the drain of the transistor is connected to the first plate of said storage capacitor forming a storage node, and wherein the second plate of said storage capacitor is connected to a pump signal. It will be apparent to one of ordinary skills in the art that the following discussion applies generally to other types of memory cells, such as DRAM, SRAM or latch. The wordlines for each row of the memory array can be of any suitable number equal to or larger than one, such as a memory cell array having multiple wordlines as set forth in US patent application "A Method and Apparatus for Selectively Updating Memory Cell Arrays" filed Apr. 2, 2003 to Richards, the subject matter being incorporated herein by reference. For clarity and demonstration purposes only, the embodiments of the present invention will be illustrated using binary-weighted PWM waveforms. It is clear that other PWM waveforms (e.g. other bit-depths and/or non binary weightings) may also be applied. Furthermore, although not limited thereto, the present invention is particularly useful for operating micromirrors such as those described in U.S. Pat. No. 5,835,256, the contents of which are hereby incorporated by reference.

Figure 1:
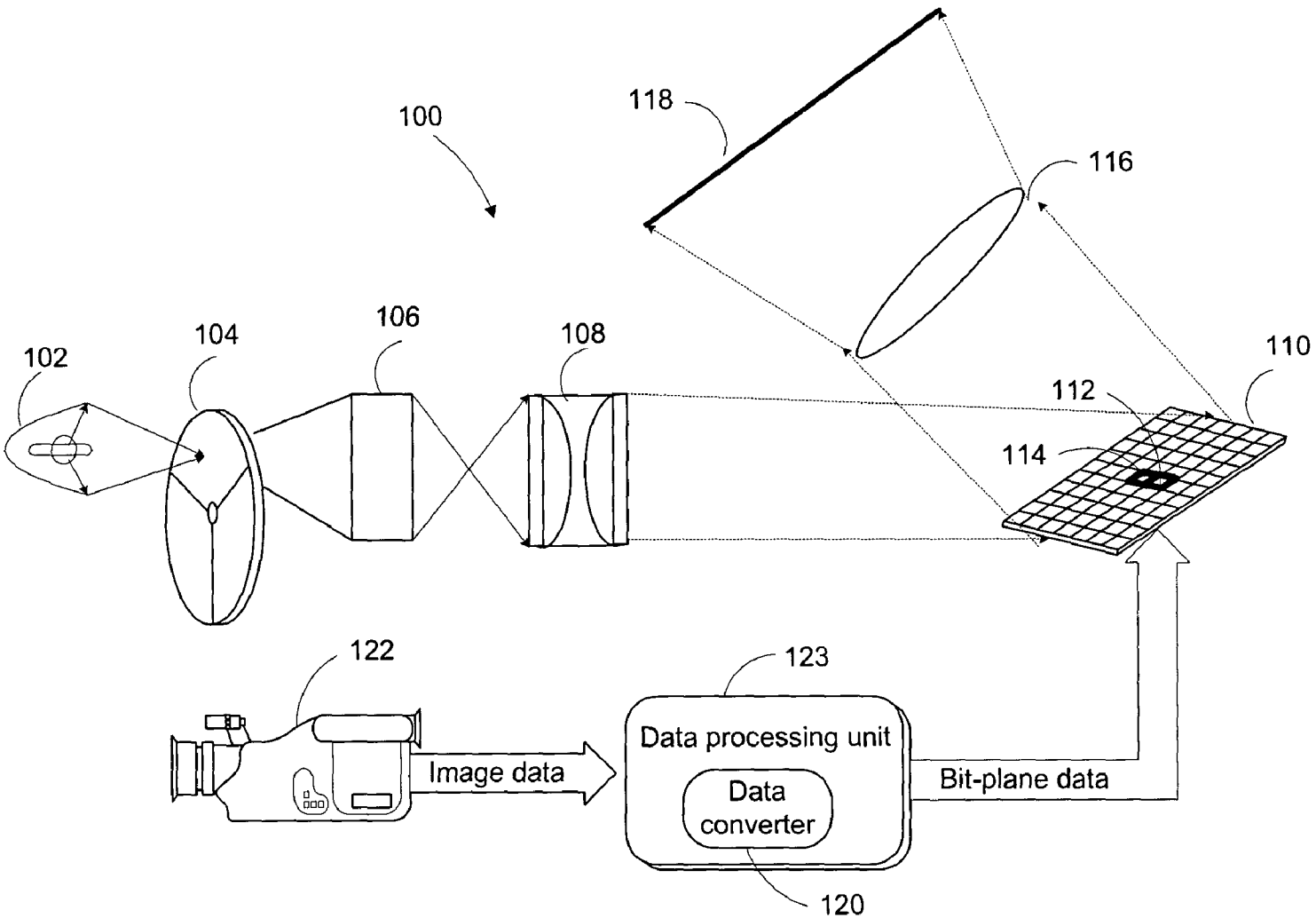
FIG. 1 illustrate an exemplary display system using a spatial light modulator having an array of micromirrors.

Turning to the drawings, FIG. 1 illustrates a simplified display system using a spatial light modulator having a micromirror array, in which embodiments of the present invention can be implemented. In its very basic configuration, display system 100 comprises light source 102, optical devices (e.g. light pipe 106, condensing lens 108 and projection lens 116), display target 118, spatial light modulator 110 that further comprises an array of micromirrors (e.g. micromirrors 112 and 114), and data processing unit 123 that further comprises data converter 120. Color filter 104 may be provided for creating color images.

Light source 102 (e.g. an arc lamp) emits light through color filter 104, light integrator/pipe 106 and condensing lens 108 and onto spatial light modulator 110. Each micromirror (e.g. micromirror 112 or 114) of spatial light modulator 110 is associated with a pixel of an image or a video frame and is can be actuated by a controller (e.g. as disclosed in U.S. Pat. No. 6,388,661 issued May 14, 2002 incorporated herein by reference) so as to reflect light from the light source either into (the micromirror at the ON state) or away from (the micromirror at the OFF state) projection optics 116, resulting in an image or a video frame on display target 118 (screen, a viewer's eyes, a photosensitive material, etc.).

Figure 2:
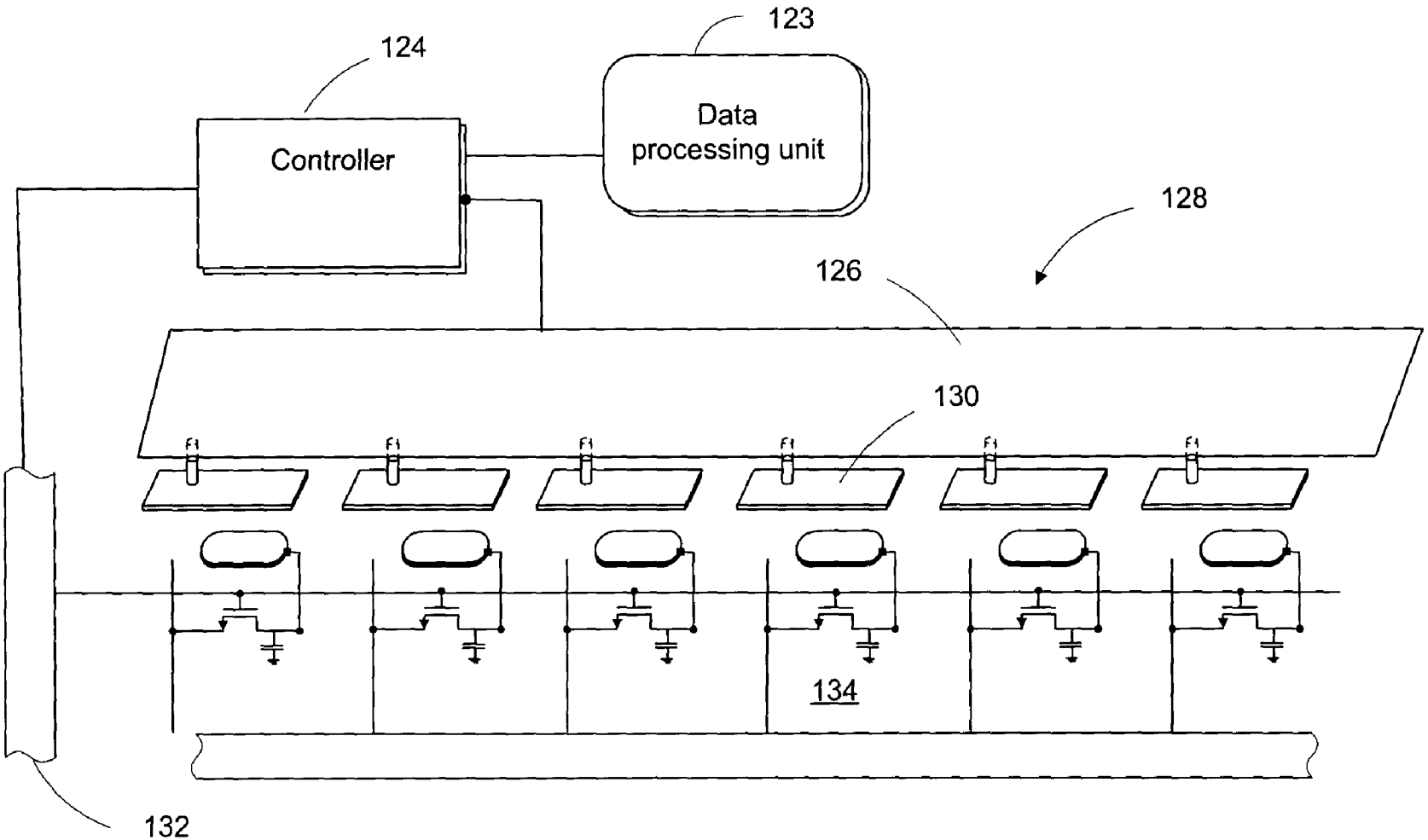
FIG. 2 is a diagram schematically illustrating a cross-sectional view of a portion of a row of the micromirror array and a controller connected to the micromirror array for controlling the states of the micromirrors of the array.

A micromirror typically comprises a movable mirror plate that reflects light and a memory cell disposed proximate to the mirror plate, which is better illustrated in FIG. 2. Referring to FIG. 2, a cross-sectional view of a portion of a row (or a column) of the micromirror array of spatial light modulator 110 in FIG. 1 is illustrated therein. Each mirror plate is movable and associated with an electrode and memory cell. For example, mirror plate 130 is associated with memory cell 134 and an electrode that is connected to a voltage node of the memory cell. In other alternative implementations, each memory cell circuit can be associated with a plurality of mirror plates. Specifically, each memory cell circuit is connected to a plurality of pixels (e.g. mirror plates) of a spatial light modulator for controlling the state of those pixels of the spatial light modulator. An electrostatic field can be established between the mirror plate and the electrode. In response to the electrostatic field, the mirror plate is rotated to the ON state or the OFF state. The data bit stored in the memory cell (the voltage node of the memory cell) determines the electrostatic field, thus determines whether the mirror plate is on or off.

In practice, rows or partial rows of memory cells are individually addressable by a plurality of wordlines, and the data bits stored in the memory cells are written through a plurality of bit lines, each of which is connected to a column of memory cells of the memory cell array. The addressing and writing the memory cells are controlled by controller 124 (e.g. the controller as disclosed in U.S. Pat. No. 6,388,661 issued May 14, 2002, the subject matter being incorporated herein by reference). The controller communicates with data processing unit 123, which prepares data, such as bitplane data, for the micromirrors.

In this figure, the memory cells are illustrated as standard 1T1C memory cells and only one wordline is provided for the row of memory cells. It should be understood than this is not an absolute requirement. Instead, other memory cells, such as a charge-pump-memory cell, DRAM or SRAM could also be used. Moreover, the memory cells of each row of the memory cell array could be provided with more than one wordline for addressing the memory cells. In particular, two wordlines could be provided for each row of memory cells of the memory cell array as set forth in U.S. patent application Ser. No. 10/340,162 filed Jan. 10, 2003 to Richards, the subject matter being incorporated herein by reference.

Turning back to FIG. 1, the spatial light modulator having the memory cell array is connected to data processing unit 123 that further comprises data converter 120. The data processing unit receives image data from peripheral image sources, such as video camera 122 and processes the received image data into pixel data as appropriate. Data converter 120 converts the pixel data into bitplane data that can be loaded into the memory cells of the memory cell array. For example, when image source 122 outputs standard analog image signals, the data processing unit samples the image signals and transforms the image signals into digital pixel data. Then data converter 120 converts the pixel data into bitplane data. Data converter 120 as illustrated in the figure is part of the data processing unit. Alternatively, the data converter can be a separate device to the data processing unit. In this case, the data converter is connected to the data processing unit. The data converter receives data from the data processing unit and outputs bitplane data to the memory cells of the memory cell array.

Figure 3:
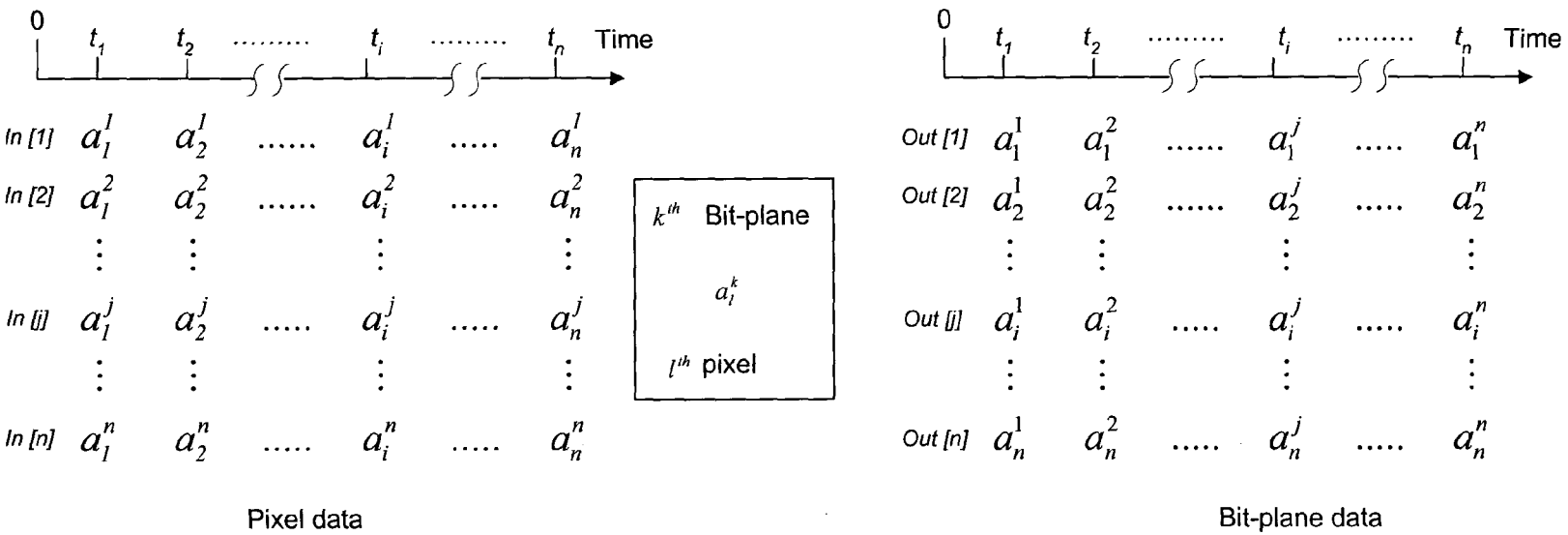
FIG. 3 illustrates an exemplary stream of pixel data and an exemplary stream of bitplane data.

Referring to FIG. 3, exemplary pixel data and exemplary bitplane data are illustrated therein. In this figure, symbol $a_l^k$ represents a binary data bit in a sense that that the data bit is either "1" or "0". "1" and "0" correspond to relative voltages of the memory cell. For example, "1" and "0" respectively correspond to a high voltage and a low voltage of the memory cell. Alternatively, "1" and "0" respectively correspond to the low voltage and the high voltage of the memory cell. The subscription l identifies the pixel of the desired image. The value of $a_l^k$ determines the voltage of the memory cell, thus the on or off state of the micromirror. The superscript k labels the bit number (or the significance) of the pixel based on the pulse-width-modulation. For example, k could be a number from 1 to n (e.g. n=8) when n data bits (e.g. 8 bits) are used to represent different grays levels (e.g. 256 levels for 8 bits) of the pixel using the pulse-width-modulation technique. The value of k determines the time of the voltage maintained by the memory cell.

The pixel data is ordered in time by the positions of pixels of the desired image. In display systems without micromirrors, data bits of the same pixel are loaded at one time for producing the pixel of the image. For example, at time $t_1$, data bits in the first column ($a_1^1, a_1^2 \ldots a_1^j \ldots a_1^n$) are loaded for producing the first pixel of the desired image. At a time $t_i$, data bits in the $i^{th}$ column ($a_i^1, a_i^2 \ldots a_i^j \ldots a_i^n$) are loaded for producing the $i^{th}$ pixel of the desired image.

In contrast, the bit plate data is primarily ordered by bits of all pixels of the desired image. In display systems using micromirrors, data bits of the same significance for all pixels of the desired image are loaded at one time for actuating the mirror plates. For example, at time $t_1$, the first bits of all n pixels in the first column ($a_1^1, a_2^1 \ldots a_i^1 \ldots a_1^1 \ldots a_1^n$) are loaded into the memory cells of the spatial light modulator for actuating the mirror plates. At another time $t_i$, data bits in the $i^{th}$ column ($a_1^i, a_2^i \ldots a_j^i \ldots a_n^i$) representing the $i^{th}$ bitplate of all pixels are loaded into the memory cells.

By comparing the pixel data matrix and the bitplane data matrix, it can be seen that the bitplane data matrix is a transpose matrix of the pixel data matrix. By "data matrix", it is meant that a block of data elements that are organized into a plurality of rows and columns of data elements. The data elements in each row are disposed in time sequence—that is the data elements in a row are delivered at different time units. The data elements in each column are delivered at the same time.

The pixel data matrix and the bitplane matrix in FIG. 3 are illustrated as square matrices n×n. In practice, the pixel data matrix can be a rectangular matrix with unequal numbers of rows and columns. As a consequence, the bitplane data matrix as a transposed matrix of the pixel data matrix is also a rectangular matrix. As illustrated in the figure, the data bits of the same pixel are arranged in the same column of the pixel data matrix and read at one time. This arrangement scheme, however, is not an absolute requirement. Instead, the data bits of the same pixel may be stored in the same row of the pixel data matrix and read at the same time. Accordingly, the bitplane matrix as a transposed matrix of the pixel data matrix is loaded into the memory cell array row by row.

Figure 4:
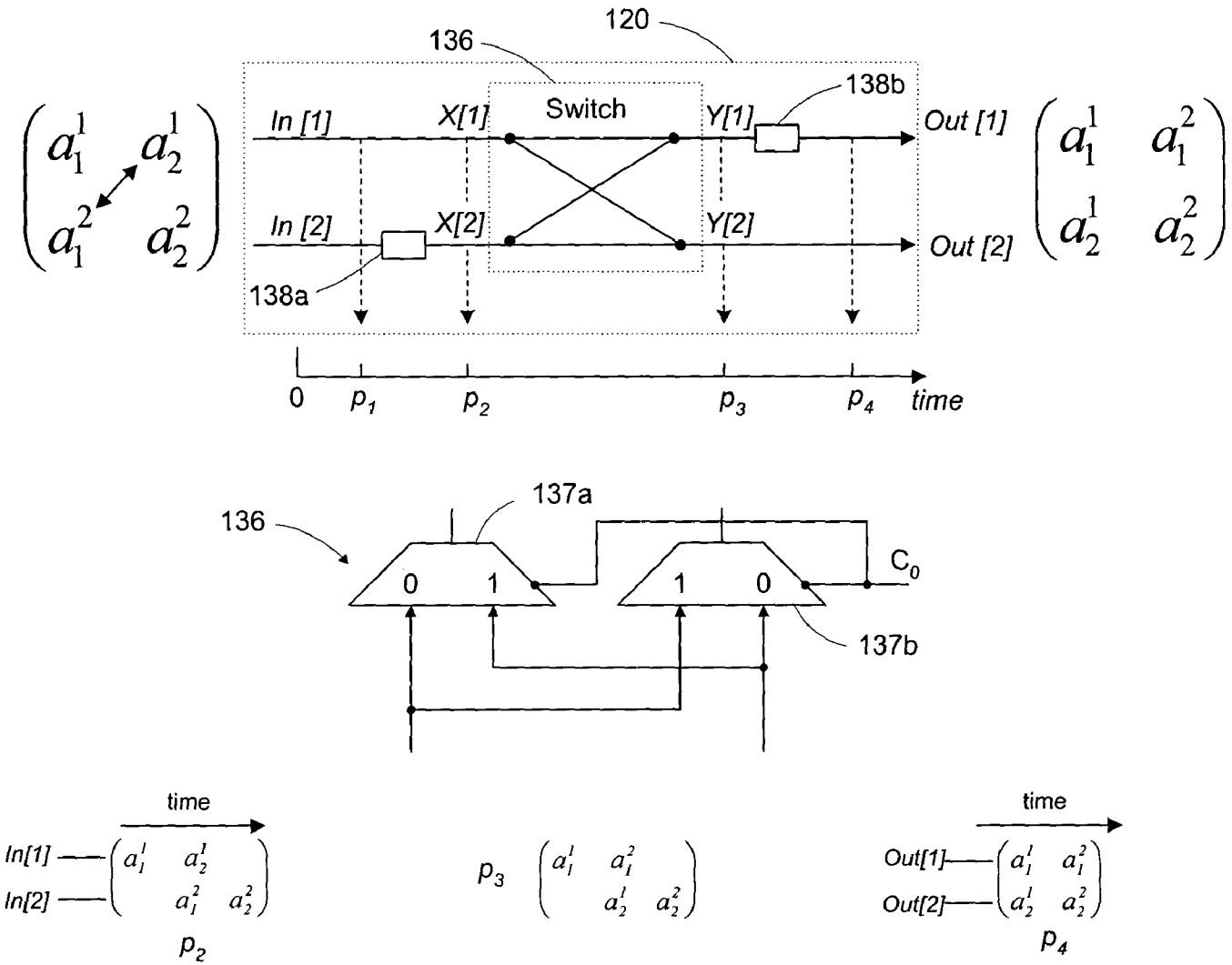
FIG. 4 illustrates an exemplary converter that converts a pixel data into a bitplane data according to an embodiment of the invention.

In order to convert a pixel data matrix into a bitplane matrix, all rows of the pixel data matrix are delivered into the data converter in parallel; and transpose operations are performed on the loaded rows simultaneously. In the following, embodiments of the invention will be discussed with reference to FIG. 4 through FIG. 11. In particular, an embodiment of the invention will be discussed with reference to a 2×2 pixel data matrix in FIG. 4. The method for transposing 2×2 pixel data matrix in FIG. 4 is extended to transpose a $2^n \times 2^n$ pixel matrix, which will be discussed in detail with reference to FIG. 5, FIG. 6 and FIG. 7 and FIG. 8. Another embodiment of the invention will be introduced with reference to FIG. 9 through FIG. 11. This method is particularly useful for transposing a pixel matrix having non-power-of-2 numbers of rows and columns. It is noted that, in practice, pixel data (and also bitplane data) in a row are delivered in time sequence—that is these data are sequentially delivered at different time units. And pixel data (and also bit plane data) in a column are delivered at the same time through, for example, a bit line of the display system. Moreover, in the embodiment of the invention, pixel data are "flowing through" the data processing unit of the display system. The data processing unit receives pixel data in a "real-time" fashion and dynamically performs the predefined transpose operation on the received pixel data. Specifically, the data processing unit receives a column of pixel data at a time-unit and dynamically performs predefined permutations to these received data so as to accomplish the transpose operation. Of course, the pixel data can be stored in a storage medium, such as a frame buffer. The data processing unit then retrieves the stored pixel data and performs the predefined transpose operation on the retrieved pixel data. It should be understood that the embodiments as discussed in the following are for demonstration and clarity purposes only. It should not be interpreted in any ways as a limitation to the present invention. Rather, any suitable methods and apparatus without departing from the spirit of the present invention could be used.

Referring to FIG. 4, data converter 120 transposes pixel data matrix having 2×2 matrix elements into bitplane data matrix. The two matrices are defined as following:

$$\text{pixel data matrix} = \begin{pmatrix} a_1^1 & a_2^1 \\ a_1^2 & a_2^2 \end{pmatrix};$$

$$\text{bitplane data matrix} = \begin{pmatrix} a_1^1 & a_1^2 \\ a_2^1 & a_2^2 \end{pmatrix}.$$

The data converter comprises a plurality of input lines (e.g. In[1] and In[2]) and output lines (e.g. Out[1] and Out[2]). In practice, the number of input lines equals or is greater than the number of rows of the pixel matrix. The data converter further comprises switch 136 and a plurality of delay units, such as delay units 138*a* and 138*b*.

Each delay unit delays a received data element at one time-unit, which may be a multiple of a clock-cycle. For example, an XGA (1024×768) video signal typically has a pixel clock of 65 MHz, or a clock period of 15.1 nanoseconds. In this case, the time-unit is preferably 15.1 nanoseconds, or a multiple of 15.1 nanoseconds. An exemplary delay unit is the standard flipflop circuit. The switch exchanges the data elements between the lines connected to the switch at certain time units. For example, when time t is odd, the switch exchanges the data elements of the delayed input lines X[1] and X[2] such that the data element on X[1] before the switch is delivered to Y[2] after the switch. And the data element on X[2] before the switch is delivered to Y[1] after the switch. When t is even, X[1] is passed through to Y[1] and X[2] is passed through to Y[2]. An exemplary switch (e.g. switch 136) is illustrated in the figure. As can be seen from the figure, switch 136 consists of two juxtaposed multiplexers 137*a* and 137*b*, both are connected to an activation signal $C_0$. In the embodiment of the invention, the activation signal toggles every time-unit (e.g. every clock cycle when the time-unit equals one clock cycle). In response to the activation signal $C_0$, the two multiplexers exchange input data bits and outputs exchanged data bits. Of course, other suitable switch circuits may also be applied.

In the transpose operation, the data converter is associated with a sequence of clock cycles. Specifically, the input lines and the output lines are synchronized with a sequence of time-units, each of which is a multiple of the clock cycle. Data elements passing through the data converter are synchronized with the sequence of time-units thereby.

According to the embodiment, data elements $a_1^1$ and $a_2^1$ in the first row and data elements $a_1^2$ and $a_2^2$ in the second row are respectively delivered to the input lines In[1] and In[2] and synchronized with the sequence of time-units. At time $p_1$, data elements $a_1^1$ and $a_2^1$ are flowing in the input line In[1] with the data element $a_1^1$ one time-unit in front of data element $a_2^1$. Data element $a_1^2$ and $a_2^2$ are flowing in the input line In[2] with data element $a_1^2$ one time-unit in front of data element $a_2^2$. Data elements $a_2^1$ and $a_2^2$ are synchronized and so are data elements $a_1^2$ and $a_1^1$. By "data elements are synchronized", it is meant that there is no time delay between the data elements with reference to a common time sequence. Data elements $a_1^2$ and $a_2^2$ then passes through delay unit 138*a* and are delayed one time-unit thereby. As a result, data element $a_2^1$ is synchronized with data element $a_1^2$—that is data elements $a_2^1$ and $a_1^2$ have the same time-unit, as shown in the figure. After delay unit 138*a*, synchronized data elements in switch input lines X[1] and X[2] are exchanged by switch 136 depending on the state of control signal $C_0$. Specifically, data element $a_1^2$ in line X[2] is may exchanged with data element $a_2^1$ in line X[1], while data elements $a_1^1$ and $a_2^2$ are unchanged, because data elements $a_1^2$ and $a_2^1$ are synchronized and data elements $a_1^1$ and $a_2^2$ have no synchronized data elements. Therefore, at $p_3$, data elements $a_1^1$ and $a_2^2$ are flowing in line Y[1] with data element $a_1^1$ one time-unit in front of data element $a_1^2$. Data elements $a_2^2$ and $a_1^2$ are flowing in input line Y[2] with data element $a_1^2$ one time-unit in front of data element $a_2^2$, as shown in the figure. After switch 136, data elements in switch output line Y[1] pass through delay unit 138*b* and are delayed one time-unit. Consequently, at $p_4$, data elements $a_1^1$ and $a_1^2$ are flowing in output line Out[1] with data element $a_1^1$ one time-unit in front of data element $a_1^2$. Data elements $a_2^2$ and $a_2^1$ are flowing in output line Out[2] with data element $a_2^1$ one time-unit in front of data element $a_2^2$. However, data elements $a_1^1$ and $a_2^1$ are synchronized. And data elements $a_1^2$ and $a_2^2$ are synchronized. The data elements are then output from out lines Out[1] and Out[2] as shown in the figure. As a result, the pixel data matrix is transposed into the bitplane data matrix that can be loaded into the memory cells for actuating the mirror plates for producing grayscale images.

It is observed that a 4×4 matrix transpose is equivalent to swapping two 2×2 sub-blocks along one diagonal of the matrix followed by transposing each of the four 2×2 sub-blocks. A data converter for transposing 4×4 matrix can be constructed by juxtaposing two above converters for transposing 2×2 sub-blocks and concatenating the juxtaposed converters to a similar circuit that swaps the 4×4 matrix in terms of the four 2×2 sub-blocks. An exemplary converter for transposing 4×4 matrices is illustrated in FIG. 6, which will be discussed in detail in following.

Figure 5:
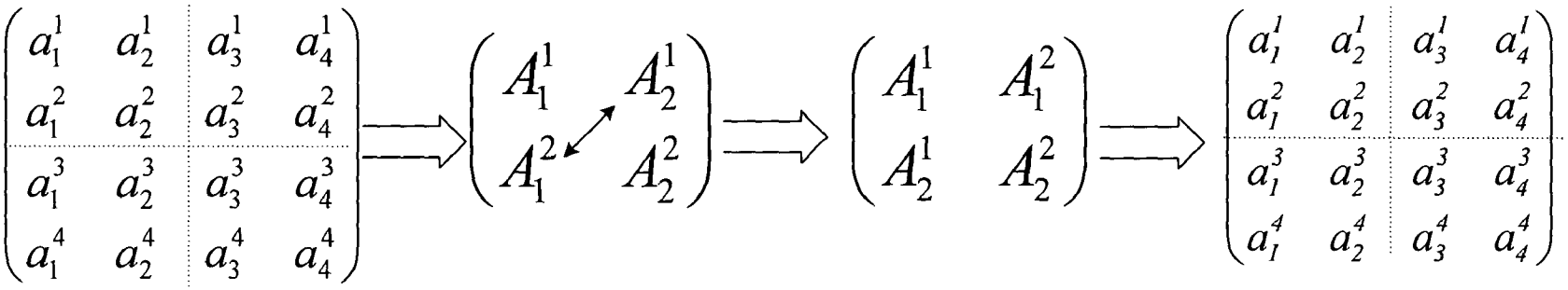
FIG. 5 illustrates an exemplary method of transforming a square matrix into another square matrix having sub-blocks with each sub-block being a 2×2 matrix.

Referring to FIG. 5, the pixel data matrix is a 4×4 matrix. The pixel data matrix is transformed into a pixel block-matrix having 2×2 sub-blocks with each sub-block being a 2×2 sub-matrix. The pixel block-matrix is then transposed in terms of the sub-blocks by swapping the two 2×2 sub-blocks along the diagonal of the matrix. After transpose of the sub-blocks, each sub-block is transposed. In order to accomplish this transpose scheme, data converter 120 is provided as illustrated in FIG. 6.

Figure 6:
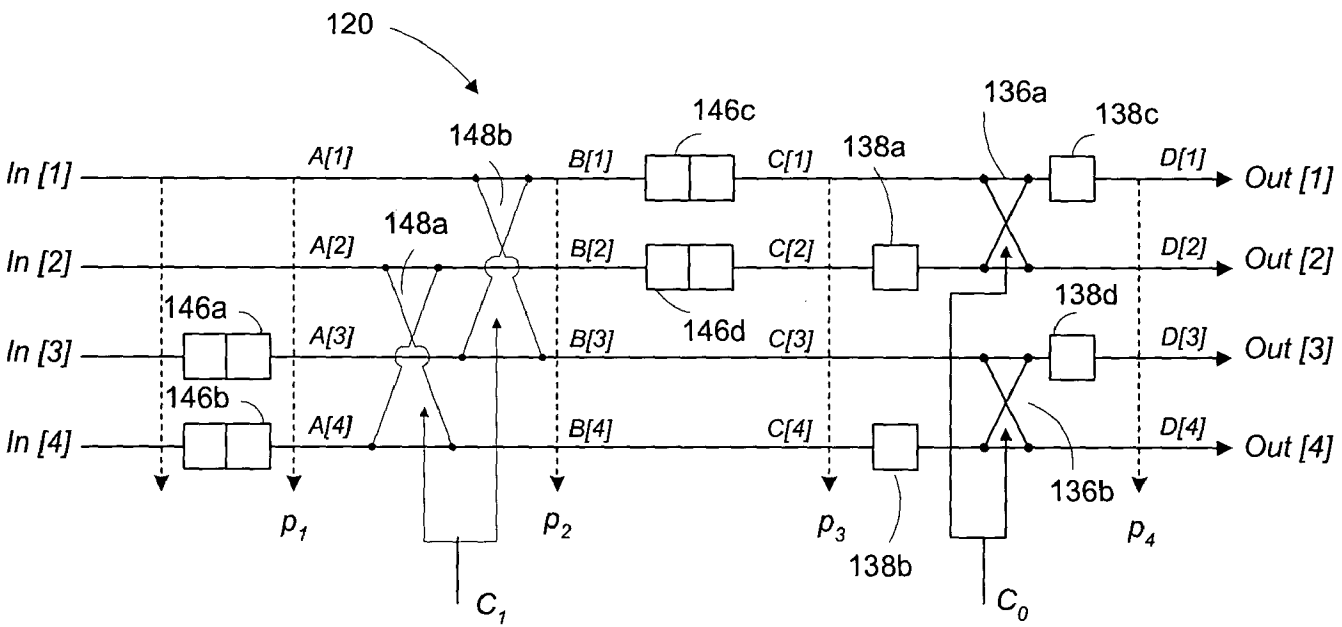
FIG. 6 illustrates another exemplary converter that converts a pixel data matrix of FIG. 6 into a bitplane data matrix of FIG. 6 according to another embodiment of the invention.

Referring to FIG. 6, data converter 120 comprises at least four input lines—In[1], In[2], In[3] and In[4], and at least four output lines—Out[1], Out[2], Out[3] and Out[4]. The data converter further comprises two juxtaposed transpose circuits, each being configured for transposing 2×2 matrices. Specifically, one of the two juxtaposed circuits consists of delay units 138*a* and 138*c* and switch 136*a*. And the other transpose circuit consists of delay units 138*b* and 138*d* and switch 136*b*. These two juxtaposed transpose circuits are concatenated with a similar blocking transposing circuit that has delay units 146*a*, 146*b*, 146*c* and 146*d* and two switches 148*a* and 148*b*. The blocking transposing circuit transposes the matrix in terms of the sub-blocks.

Switch 148*a* exchanges data elements between lines In[2] and In[4], and switch 148*b* exchanges data elements between lines In[1] and In[3]. Switch 136*a* exchanges data elements between lines In[1] and In[2], and switch 136*b* exchanges data elements between lines In[3] and In[4]. The switches 148*a* and 148*b* can be the same as the switch 136*a* or switch 136*b*. However, this is not an absolute requirement. Instead, each of the switches can be different from the other switches. Control signal $C_1$ (controlling the first stage of switches) toggles ON for 2 clock cycles and OFF for 2 clock cycles, as shown in the figure, while control signal $C_0$ controls the 2×2 transposers similarly to that shown in FIG. 4. $C_1$ and $C_0$ must be appropriately delayed with respect to the data and the pipeline delays of the delay stages.

In accordance with an embodiment of the invention, the data converter is associated with clock cycles. Specifically, the input lines and the output lines In[1], In[2], In[3] and In[4] are synchronized with a sequence of time-units, each of which may be a clock cycle or a multiple of a clock cycle. In the embodiment of the invention, the time-unit equals one clock cycle. Data elements pass through the input lines of the data converter are synchronized with the sequence of time-units thereby.

In the transpose operation, data elements of the pixel data matrix in each row are sequentially delivered into an input line in accordance with the sequence of time units. Data elements of the pixel data matrix in separate rows are delivered into different input lines in parallel. At time t=0, data elements $a_1^1$, $a_2^1$, $a_3^1$ and $a_4^1$ are delivered to the first input line with the data elements sequentially spaced with one time-unit. Specifically, data element $a_i^1$ is one time-unit in front of data element $a_{i+1}^1$. Similar to the data elements in the first row, data elements $a_1^2$ through $a_4^2$ in the second row, data elements $a_1^3$ through $a_4^3$ in the third row, and data elements $a_1^4$ through $a_4^4$ in the fourth row are respectively delivered to the input lines In[2], In[3], and In[4]. For the data elements in the same input line, data elements are sequentially spaced with one time-unit. Data elements in the same column are synchronized.

The data elements of the third row and the fourth row are then delayed two time-units for each data element by delay units 146*a* and 146*b*. As a result, at time $p_1$, data elements $a_1^3$ and $a_1^4$ are synchronized with data elements $a_3^2$ and $a_3^1$. Data elements $a_2^4$ and $a_2^3$ are synchronized with data elements $a_4^2$ and $a_4^1$.

After being delayed, data elements in the input lines are exchanged by switches 148*a* and 148*b*. Specifically, switch 148*a* exchanges data elements between input lines In[2] and In[4], and switch 148*b* exchanges data elements between input lines In[1] and In[3]. Both switches perform the exchange in response to control signal $C_1$, which toggles ON for 2 clock cycles and OFF for 2 clock cycles, as shown in the figure. As a consequence, at $p_2$, data elements $a_1^1$, $a_2^1$, $a_1^3$, $a_2^3$ are flowing in line A[1]. Data elements $a_1^2$, $a_2^2$, $a_4^1$, $a_4^2$, are flowing in line A[2]. Data elements $a_3^1$, $a_4^1$, $a_3^3$, $a_4^3$ are flowing in line A[3]. And data elements $a_3^2$, $a_4^2$, $a_3^4$, $a_4^4$ are flowing in line A[4].

Following switches 148*a* and 148*b*, data elements in the first row and the second row are delayed two time-units by delay units 146*c* and 146*d*. As a result, at $p_3$, data elements of the first row and the second row are synchronized with the corresponding data elements in the third row and the fourth row. For example, data elements $a_1^1$ and $a_1^2$ in the first two rows (the first row and the second row) and first column are synchronized with data elements $a_3^1$ and $a_3^2$ in the last two (the third and the fourth) rows and first column.

After delay units 146*c* and 146*d*, transpose of the pixel block matrix is complete. Delay units 138*a*, 138*b*, 138*c* and 138*d*, and switched 136*a* and 136*b* then perform transpose to the sub-block matrix of the transposed pixel block matrix. Table 1 summarizes the timing of the transposing operation discussed above.

TABLE 1

| Time | 0 | 1 | 2 | 3 | 4 | 5 | 6 | 7 | 8 | 9 | 10 |
|---|---|---|---|---|---|---|---|---|---|---|---|
| $C_1$ | 0 | 0 | 1 | 1 | 0 | 0 | 1 | 1 | 0 | 0 | |
| In[1] | $a_1^1$ | $a_2^1$ | $a_3^1$ | $a_4^1$ | $a_5^1$ | $a_6^1$ | $a_7^1$ | $a_8^1$ | | | |
| In[2] | $a_1^2$ | $a_2^2$ | $a_3^2$ | $a_4^2$ | $a_5^2$ | $a_6^2$ | $a_7^2$ | $a_8^2$ | | | |
| In[3] | $a_1^3$ | $a_2^3$ | $a_3^3$ | $a_4^3$ | $a_5^3$ | $a_6^3$ | $a_7^3$ | $a_8^3$ | | | |
| In[4] | $a_1^4$ | $a_2^4$ | $a_3^4$ | $a_4^4$ | $a_5^4$ | $a_6^4$ | $a_7^4$ | $a_8^4$ | | | |
| A[1] | $a_1^1$ | $a_2^1$ | $a_3^1$ | $a_4^1$ | $a_5^1$ | $a_6^1$ | $a_7^1$ | $a_8^1$ | | | |
| A[2] | $a_1^2$ | $a_2^2$ | $a_3^2$ | $a_4^2$ | $a_5^2$ | $a_6^2$ | $a_7^2$ | $a_8^2$ | | | |
| A[3] | | | $a_1^3$ | $a_2^3$ | $a_3^3$ | $a_4^3$ | $a_5^3$ | $a_6^3$ | $a_7^3$ | $a_8^3$ | |
| A[4] | | | $a_1^4$ | $a_2^4$ | $a_3^4$ | $a_4^4$ | $a_5^4$ | $a_6^4$ | $a_7^4$ | $a_8^4$ | |
| B[1] | $a_1^1$ | $a_2^1$ | $a_1^3$ | $a_2^3$ | $a_5^1$ | $a_6^1$ | $a_5^3$ | $a_6^3$ | | | |
| B[2] | $a_1^2$ | $a_2^2$ | $a_1^4$ | $a_2^4$ | $a_5^2$ | $a_6^2$ | $a_5^4$ | $a_6^4$ | | | |
| B[3] | | | $a_3^1$ | $a_4^1$ | $a_3^3$ | $a_4^3$ | $a_7^1$ | $a_8^1$ | $a_7^3$ | $a_8^3$ | |
| B[4] | | | $a_3^2$ | $a_4^2$ | $a_3^4$ | $a_4^4$ | $a_7^2$ | $a_8^2$ | $a_7^4$ | $a_8^4$ | |
| C[1] | | | $a_1^1$ | $a_2^1$ | $a_1^3$ | $a_2^3$ | $a_5^1$ | $a_6^1$ | $a_5^3$ | $a_6^3$ | |
| C[2] | | | $a_1^2$ | $a_2^2$ | $a_1^4$ | $a_2^4$ | $a_5^2$ | $a_6^2$ | $a_5^4$ | $a_6^4$ | |
| C[3] | | | $a_3^1$ | $a_4^1$ | $a_3^3$ | $a_4^3$ | $a_7^1$ | $a_8^1$ | $a_7^3$ | $a_8^3$ | |
| C[4] | | | $a_3^2$ | $a_4^2$ | $a_3^4$ | $a_4^4$ | $a_7^2$ | $a_8^2$ | $a_7^4$ | $a_8^4$ | |
| $C_0$ | | | 0 | 1 | 0 | 1 | 0 | 1 | 0 | 1 | 0 |
| D[1] | | | $a_1^1$ | $a_2^1$ | $a_1^3$ | $a_2^3$ | $a_5^1$ | $a_6^1$ | $a_5^3$ | $a_6^3$ | |
| D[2] | | | | $a_1^2$ | $a_2^2$ | $a_1^4$ | $a_2^4$ | $a_5^2$ | $a_6^2$ | $a_5^4$ | $a_6^4$ |
| D[3] | | | $a_3^1$ | $a_4^1$ | $a_3^3$ | $a_4^3$ | $a_7^1$ | $a_8^1$ | $a_7^3$ | $a_8^3$ | |
| D[4] | | | | $a_3^2$ | $a_4^2$ | $a_3^4$ | $a_4^4$ | $a_7^2$ | $a_8^2$ | $a_7^4$ | $a_8^4$ |
| E[1] | | | $a_1^1$ | $a_1^2$ | $a_1^3$ | $a_1^4$ | $a_5^1$ | $a_5^2$ | $a_5^3$ | $a_5^4$ | |
| E[2] | | | | $a_2^1$ | $a_2^2$ | $a_2^3$ | $a_2^4$ | $a_6^1$ | $a_6^2$ | $a_6^3$ | $a_6^4$ |
| E[3] | | | $a_3^1$ | $a_3^2$ | $a_3^3$ | $a_3^4$ | $a_7^1$ | $a_7^2$ | $a_7^3$ | $a_7^4$ | |
| E[4] | | | | $a_4^1$ | $a_4^2$ | $a_4^3$ | $a_4^4$ | $a_8^1$ | $a_8^2$ | $a_8^3$ | $a_8^4$ |
| Out[1] | | | | $a_1^1$ | $a_1^2$ | $a_1^3$ | $a_1^4$ | $a_5^1$ | $a_5^2$ | $a_5^3$ | $a_5^4$ |
| Out[2] | | | | $a_2^1$ | $a_2^2$ | $a_2^3$ | $a_2^4$ | $a_6^1$ | $a_6^2$ | $a_6^3$ | $a_6^4$ |
| Out[3] | | | | $a_3^1$ | $a_3^2$ | $a_3^3$ | $a_3^4$ | $a_7^1$ | $a_7^2$ | $a_7^3$ | $a_7^4$ |
| Out[4] | | | | $a_4^1$ | $a_4^2$ | $a_4^3$ | $a_4^4$ | $a_8^1$ | $a_8^2$ | $a_8^3$ | $a_8^4$ |

Figure 7:
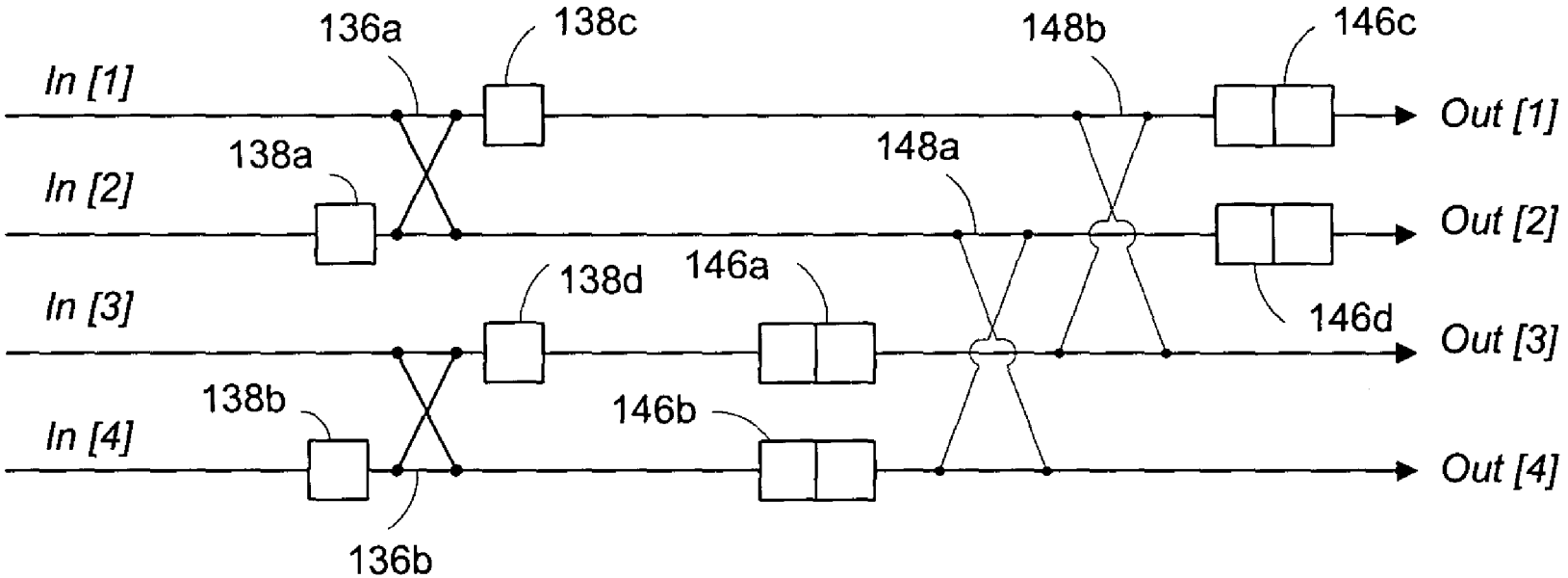
FIG. 7 illustrates another exemplary converter that converts a pixel data matrix of FIG. 6 into a bitplane data matrix of FIG. 6 according to another embodiment of the invention.

As discussed above, data converter 120 in FIG. 6 is configured such that a transposing circuit (having delay units 146*a* through 146*d* and switches 148*a* and 148*b*) for transposing data matrices in terms of sub-blocks is disposed in front of the two juxtaposed transpose circuits, each being designated for transposing 2×2 sub-blocks. Accordingly, a 4×4 pixel matrix is transposed in terms of sub-blocks followed by transposes of the sub-blocks. This configuration, however, is not an absolute requirement. Other suitable configurations may also be applied. For example, the two transpose circuits for transposing sub-blocks can be placed in front of the transpose circuit for transposing the matrix in terms of the sub-blocks. Such a configuration is illustrated in FIG. 7. As can be seen from FIG. 7, delay units 138*a*, 138*b*, 138*c* and 138*d*, and switches 136*a* and 136*b* are disposed in front of delay units 146*a* through 146*d* and switches 148*a* and 148*b*. By this arrangement, transposes of the sub-blocks are performed before the transpose of the matrix in terms of the sub-blocks.

From the above discussion, it can be seen that the method and the apparatus for transposing 2×2 pixel matrices can be extended to transpose 4×4 pixel matrices. This method and apparatus can be recursively extended to build data converters for transposing a pixel data matrix having $2^n \times 2^n$ data elements, wherein n is an integer larger than 2.

For transposing such pixel data matrices into bitplane matrices, the $2^n \times 2^n$ pixel data matrix is first transformed into a pixel block matrix having 2×2 first order sub-blocks. Each first order sub-block has four 2×2 second order sub-blocks, and each second order sub-block has four 2×2 third order blocks. By iterating such transformation method, the $2^n \times 2^n$ pixel data matrix is transformed into a pixel block matrix having a plurality of sub-blocks with orders. Each $k^{th}$ order sub-block has 2×2 $(k+1)^{th}$ order sub-blocks, and the $(n-1)^{th}$ order sub-block is a matrix having 2×2 pixel data elements.

In accordance with an embodiment of the invention, the transformed pixel data matrix is first transposed based on the $(n-1)^{th}$ order sub-blocks, each of which has 2×2 pixel data elements following by transposing the pixel data block matrix based on the $(n-2)^{th}$ order sub-blocks. The pixel data matrix is transposed based on the $k^{th}$ order sub-blocks after consecutive transposes of the pixel data matrix based on the $(n-1)^{th}$ order sub-blocks through the $(k+1)^{th}$ order sub-blocks. Then the pixel data block is transposed based on the first order blocks.

Figure 8:
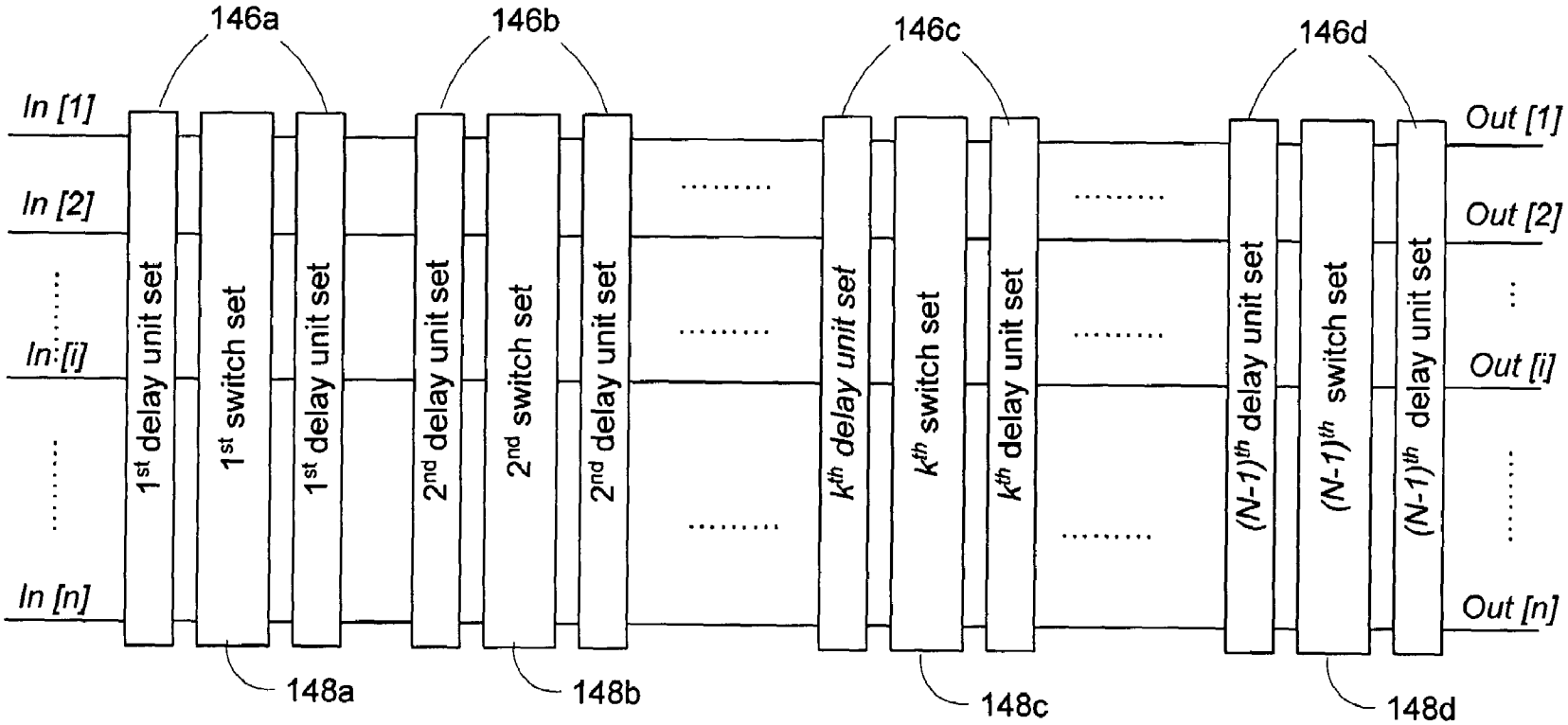
FIG. 8 illustrates yet another exemplary converter that converts a pixel data into a bitplane data according to yet another embodiment of the invention.

In order to transpose the pixel block matrix into bitplane matrix, the rows of the pixel block matrix are delivered in parallel into a data converter that comprises a plurality of input lines (e.g. In[1] through In[n]), a set of delay-unit sets (e.g. delay unity sets 1 through n−1) and a set of switch sets (e.g. switch sets 1 through n−1), as illustrated in FIG. 8. The combination of the $1^{st}$ delay unit set 146*a* and the $1^{st}$ switch set 148*a* performs transpose of the $(n-1)^{th}$ order sub-blocks. The combination of the 2 delay unit set 146*b* and the $2^{nd}$ switch set 148*b* performs transpose of the $(n-2)^{th}$ order sub-blocks that has 2×2 pixel data elements. The combination of the k h delay unit set 146*c* and the $k^{th}$ switch set 148*c* performs transpose on the $(n-k-1)^{th}$ order sub-blocks. And the combination of the $2^{n-1}$ delay unit set 146*d* and the $2^{n-1}$ switch set 148*d* performs transpose on the $1^{st}$ order sub-blocks. It can also be seen from the figure that, different combinations of the delay unit sets and the switch sets are disposed consecutively. Specifically, the combination of the delay unit set and the switch set with a lower order immediately follows the combination of the delay unit set and the switch set with one order higher. For example, the combination of the $2^{nd}$ order delay unit set and the $2^{nd}$ order switch set is immediately behind the combination of the 1st order delay unit set and the $1^{st}$ order switch set. For another example, the combination of the $k^{th}$ order delay unit set and the $k^{th}$ order switch set is immediately behind the combination of the $(k-1)^{th}$ order delay unit set and the $(k-1)^{th}$ order switch set. This arrangement allows for consecutive transposes of sub-matrices with consecutive orders. Moreover, this arrangement guarantees that the transpose of the $k^{th}$ order sub-block matrix is performed after all transposes on the sub-block matrices with orders from n−1 to k.

Each delay unit set comprises one or more delay units (e.g. the delay unit 138*a* or 138*b* in FIG. 4). The delay unit can be a standard flipflop circuit or a shift-register. In the embodiment of the invention, the total number of the delay units in each delay unit set equals $2^{2n-1}$ times the order of the delay unit set. For example, the $k^{th}$ delay unit set has $2^{2k-1}$ delay units, each of which delays the received data elements one time-unit. Therefore, the total delayed time-units by the $k^{th}$ delay unit set is $2^{2k-1}$ time units. Each switch set comprises at least two switches, such as switch 136 in FIG. 4. According to the embodiment, each switch set is "sandwiched" by two delay unit sets. For example, the $1^{st}$ switch set is dispose in the middle of two serially disposed $1^{st}$ delay unit sets. The $k^{th}$ switch set is disposed in the middle of two serially disposed $k^{th}$ delay unit sets.

In performing the transpose of the pixel block matrix based on the $(n-1)^{th}$ order sub-blocks each having 2×2 pixel data elements, each $(n-1)^{th}$ order sub-block is transposed by delaying the data elements in the second row of the $(n-1)^{th}$ order sub-block one time-unit relative to the data elements in the first row of the $(n-1)^{th}$ order block; and delaying the data elements in the second column in each row one time-unit relative to the data elements in the first column of the same row of the $(n-1)^{th}$ order sub-block. The delay is performed by the $1^{st}$ delay unit set 146*a* in FIG. 8. The data elements of the delayed $(n-1)^{th}$ order sub-block is then switched at each time-unit by the $1^{st}$ switch set 148 in FIG. 8 according to a predefined switching rule. The switching rule is listed in table 2.

TABLE 2

| | $1^{st}$ order | $2^{nd}$ order | $K^{th}$ order | $n^{th}$ order |
|---|---|---|---|---|
| Delay time | 1 time unit | 2 time units | $2^{k-1}$ time units | $2^{n-1}$ time units |
| Switch rule | $R_1 \leftrightarrow R_2$ | $R_1 \leftrightarrow R_3$<br>$R_2 \leftrightarrow R_4$ | $R_1 \leftrightarrow R_{(k/2+1)}$<br>$R_2 \leftrightarrow R_{(k/2+2)}$<br>$R_i \leftrightarrow R_{(k/2+i)}$<br>$R_{k/2} \leftrightarrow R_k$ | $R_1 \leftrightarrow R_{(n/2+1)}$<br>$R_2 \leftrightarrow R_{(n/2+2)}$<br>$R_i \leftrightarrow R_{(n/2+i)}$<br>$R_{n/2} \leftrightarrow R_n$ |

In the table, $R_i \leftrightarrow R_j$ represents an exchange operation by which data element in row i is conditionally exchanged with data element in row j at a given time-unit based on a control signal.

After being switched, the data elements of the first row of the $(n-1)^{th}$ order sub-block are then delayed one time unit by the $1^{st}$ delay unit set.

In performing the transpose of the pixel data matrix based on the first order sub-blocks, the data elements of the pixel data block matrix are delayed by the $(N-1)^{th1}$ delay unit set 146*d* in FIG. 8 according to a sequence of time-units such that: a) data elements of rows 1 through n/2 are not delayed; b) for data elements of rows from n/2+1 through n, data elements at column i and row j is delayed one time-units relative to the data element at column i+1 and row j, and is delayed n/2 time-units relative to the data element at the same column and the first row. The delayed data elements are then switched by the $(N-1)^{th}$ switch set 148*d* in FIG. 8 according to the switch rule in table 1. Specifically, the switch rule states that: at each time-unit, a) exchanging the data element of row 1 with the data element of row (n/2+1) at the time-unit; and b) exchanging the data element of row i with the data element of row (n/2+i). The switched data elements are then delayed according to the sequence of time-units such that: a) data elements of rows n/2+1 through n are not delayed; b) for data elements of rows from 1 through n/2, data elements at column i and row j is delayed one time-unit relative to the data element at column i+1 and row j, and is delayed n/2 time-units relative to the data element at the same column and the first row.

After consecutively performing the transposes of sub-blocks with consecutive orders starting from n−1 to 1 by the data converter of FIG. 8, the pixel data matrix having $2^n \times 2^n$ pixel data elements is transposed into a bitplane data matrix.

Rather than arranging the delay unit sets and the switch sets in an order as illustrated in FIG. 8, the delay unit sets and the switch sets can be arranged in an inverse order. Specifically, the combination of the delay unit set and the switch set with a lower order immediately in front of the combination of the delay unit set and the switch set with one order higher. For example, the combination of the $2^{nd}$ order delay unit set and the $2^{nd}$ order switch set can be immediately in front of the combination of the $1^{st}$ order delay unit set and the $1^{st}$ order switch set, as long as the other delay unit sets and switch sets obey the same inversed arrangement order. For another example, with the inverted arrangement order, the combination of the $k^{th}$ order delay unit set and the $k^{th}$ order switch set is immediately in front of the combination of the $(k-1)^{th}$ order delay unit set and the $(k-1)^{th}$ order switch set. And the combination of the $(N-1)^{th}$ delay unit set and the $(N-1)^{th}$ switch set is placed in the front of the data converter—that is, pixel data elements of the pixel data matrix are delivered first into the combination of the $(N-1)^{th}$ delay unit set and the $(N-1)^{th}$ switch set.

Rather than arranging the delay units sets and the switch sets in the ascending order (as shown in FIG. 8) or the descending order as discussed above, the delay units and the switch sets can be arranged randomly. Specifically, combinations of the delay unit sets and the switch set of the same order can be disposed randomly along the input lines. For example, the combination of the $m^{th}$ order delay unit sets and the $m^{th}$ order switch set can be disposed between a combination of the $i^{th}$ order delay unit sets and the $i^{th}$ order switch set and a combination of the $j^{th}$ order delay unit sets and the $j^{th}$ order switch set, wherein $i \neq m \pm 1$ and $j \neq m \pm 1$. Accordingly, the pixel data matrix is transposed by random orders.

In addition to a pixel data matrix having $2^n \times 2^n$ pixel data elements, the method and the data converter as discussed with reference to FIG. 8 can be also be applied in transposing pixel data matrices having $2^n \times m$ pixel data elements with m being an integer not equal to $2^n$ into a bitplane data matrix.

For a pixel data matrix having $2^n \times m$ pixel data elements with m being an integer smaller than $2^n$, a number of rows of "fake" data elements can be inserted into the pixel data matrix such that the pixel data matrix after insertion is a $2^n \times 2^n$ pixel data matrix. Each row of "fake" data elements consists $2^n$ "fake" data elements, and $(2^n - m)$ such rows are inserted into the pixel data matrix. These "fake" data rows can be attached inserted before the first row of the pixel data matrix, or appended after the last row of the pixel data matrix, or inserted between the rows of the pixel data matrix, as long as the insert positions are memorized.

After performing the transpose method discussed above, the inserted "fake" data elements are removed from the transposed pixel data matrix having "fake" data elements. As a way of example, $(2^n - m)$ rows of "fake" data elements are appended after the $m^{th}$ row of the pixel data matrix. After transpose, the "fake" data elements are located at positions from the $(2^n - m)^{th}$ column to the $(2^n)^{th}$ column in each row. Therefore, by truncating the columns from the $(2^n - m)^{th}$ column to the $(2^n)^{th}$ column, the bitplane matrix is obtained. These 'fake' data elements may be implemented by hard-wiring some inputs of the transposer to 0 or 1; this may allow some of the delay elements or parts of the switch logic to be optimized away or reduced.

The methods and the apparatus as discussed with reference to FIG. 4 through FIG. 8 can be characterized using a plurality of parameters, such as the longest path delay, the total number of flipflops, the total number of shift-registers, the total number of multiplexers and the control signal fanout. The longest path delay is defined as the length of the longest combinational logic path between delay elements or I/Os, in terms of 2-input multiplexers. The control signal fanout is defined as the total number of loads driven by any control signal to the switches/multiplexers (e.g. the multiplexers 137*a* and 137*b* in FIG. 4). Values of these parameters are listed in table 2 when the method and the apparatus as discussed above are employed in transposing a matrix having N columns, where N is a power of 2. In certain implementation technologies, the cost (in terms of circuit area) of a multiple-cycle delay element (i.e. a shift register) may be significantly less than the cost of the corresponding number of individual flipflops. For example, certain FPGA architectures allow implementation of a 16-element shift register in a single logic block. For this reason the table also tallies the total number of shift registers (of arbitrary length) in the design which may be more representative of the area cost of the design in such technologies.

TABLE 3

| Longest path delay | Number of Flipflops | Number of shift-registers | Number of multiplexers | Control fanout |
|---|---|---|---|---|
| $\log_2 N$ | $N^2 - N$ | $(3/4)N\log_2 N + (1/4)\log_2 N$ | $N\log_2 N$ | N |

In practice, the pixel data matrix can be a rectangular matrix having m columns and n rows where n may not be a power of 2. A method and an apparatus for transposing such pixel data matrices will be discussed in the following with reference to FIG. 9 through FIG. 11. Obviously, such method and apparatus are also applicable for transposing $2^n \times 2^n$ pixel data matrices and $2^n \times m$ pixel data matrices.

Figure 9:
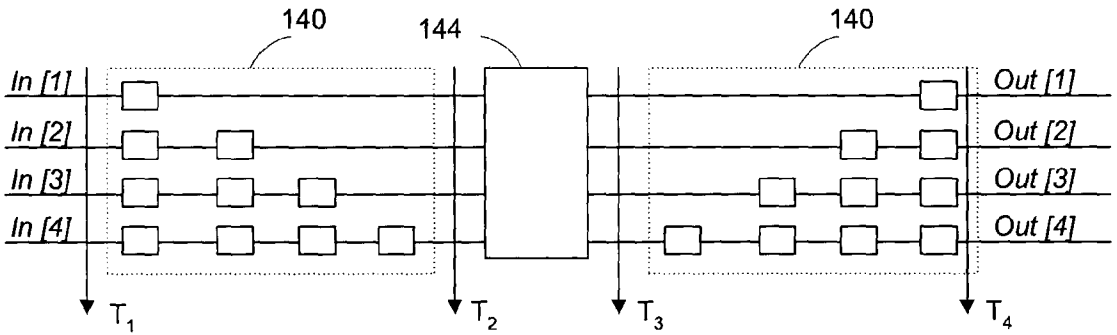
FIG. 9 illustrates yet another exemplary converter that converts a pixel data into a bitplane data according to yet another embodiment of the invention.

Referring to FIG. 9, the data converter comprises delay unit set 140 and shifter 144, which is preferably a barrel shifter. Under control of a set of control signals, the barrel shifter provides on its output a circularly rotated version of its inputs, where the number of positions the data is rotated is determined by the control inputs. An exemplary barrel shifter is illustrated in FIG. 11. Referring to FIG. 11, the barrel shifter comprises N inputs, represented by In[1], In[2], through In[N], and N outputs, represented by Out[1] through Out[N]. In response to a control signal "Q", the N input data are circularly rotated with Q positions as shown in the figure, wherein Q is an integer less than N. Referring back to FIG. 10, for simplicity and demonstration purposes only, only four input lines and four out lines are illustrated in the barrel shifter in the figure.

According to the embodiment of the invention, delay unit set 140 comprises a set of delay units, such as the delay unit 138*a* or 138*b* in FIG. 4. For example, the delay unit can be a flipflop circuit or a shift register. The delay units are deployed along the input lines of the data converter such that k number of delay units are disposed along the $k^{th}$ input line in front of shifter 144, and another k number of delay units are disposed along the $k^{th}$ input line after shifter 144. For example, one delay unit is disposed along the first input line In[1] in front of shift 144 and another delay unit is disposed along the first input line after shifter 144. For another example, three delay units are disposed along the third input line In[3] in front of shift 144 and another three delay units are disposed along the third input line after shifter 144.

Figure 10:
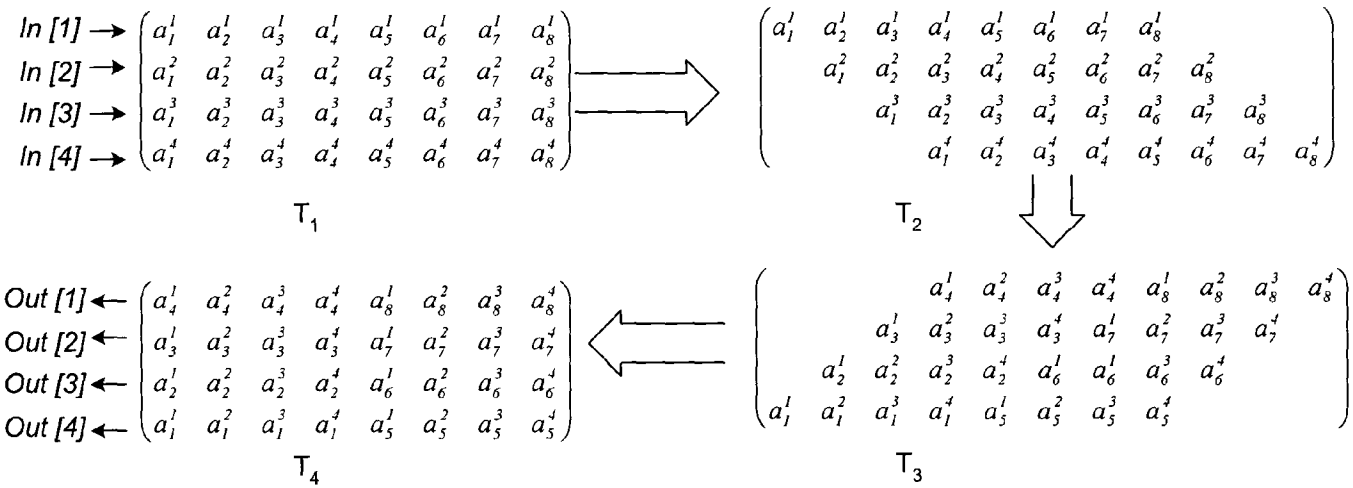
FIG. 10 illustrates matrices at different stages of a conversion executed by the converter of FIG. 9.
Figure 11:
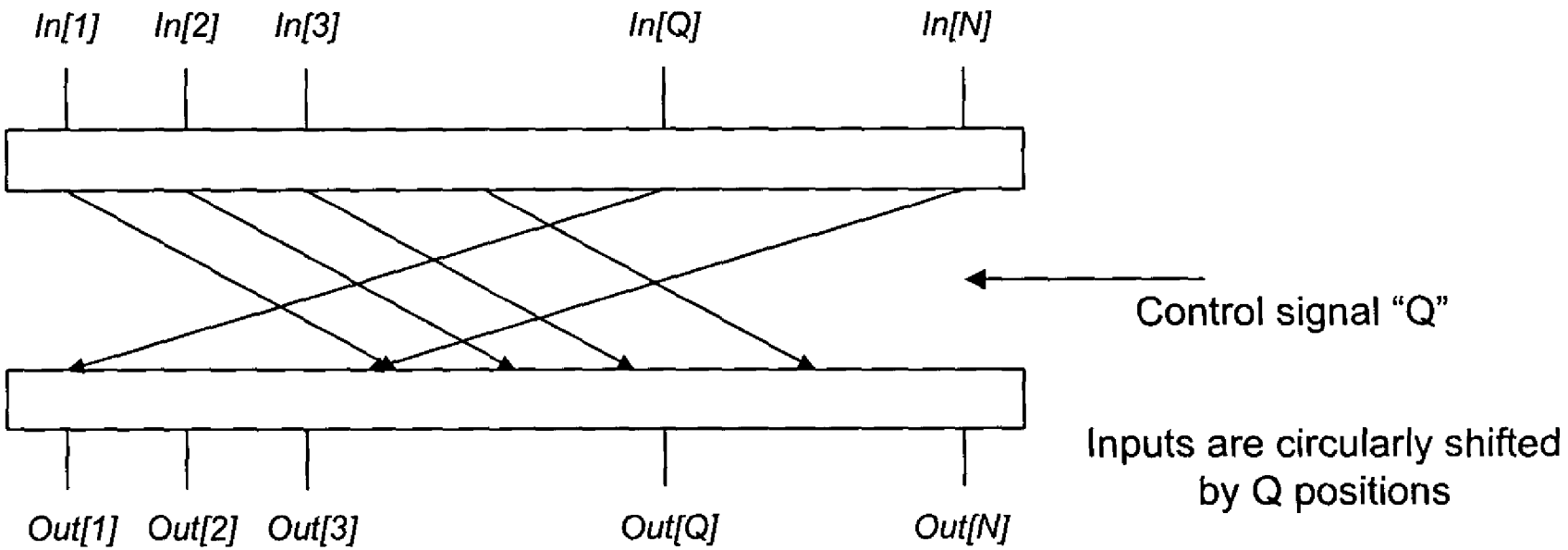
FIG. 11 illustrates an exemplary shift-register used by the converter of FIG. 9.

For simplicity and demonstration purposes, the transposing method using the data converter in FIG. 9 will be discussed with reference to transposing a rectangular matrix having eight columns and four rows as illustrated in FIG. 10.

In the transpose operation, the data converter is associated with clock cycles. Specifically, the input lines are synchronized with a sequence of time-units, each being a multiple of a clock cycle. As a result, data elements flowing through the input lines are synchronized with the sequence of time units.

The four rows are separately connected to the four input lines—In[1], In[2], In[3] and In[4] such that pixel data elements of separate rows are delivered into the input lines of the data converter in parallel. The pixel data elements in each row are delivered sequentially into an input line such that the adjacent pixel data elements in a row have one time-unit difference in time relative to each other. Specifically, data element $a_i^j$ of row j is delayed one time-unit relative to data element $a_{i+1}^j$ of the same row. For example, $a_3^2$ is delayed one time-unit relative to data element $a_2^2$. Data elements of the same column are synchronized with one time-unit. The data elements then pass through delay unit set 140 located in front of shifter 144 and are delayed thereby. Consequently, a pixel data at column i and row j is delayed (j−1) time-units relative to the data at column i and the first row, and one time-unit relative to the data element at column i+1 and row j as shown in the matrix at position $T_2$. The delayed data elements are then shifted by shifter 144 according to the sequence of time-units and based on a shifting rule. In the embodiment of the invention, the shifting rule states that: for a matrix having m columns and n rows, a) the data element of row j at the $k^{th}$ time-unit of the time-unit sequence is shifted to row ((n+j−k−1) mod n)+1 at the same time-unit; wherein k runs from 1 to m+n time-units. An exemplary shift operation is illustrated in FIG. 11. As shown in FIG. 11, a sequence of data bits in a register is shifted rightwards sequentially. The data bit at the $n^{th}$ position is shifted to the $0^{th}$ position of the register. Turning back to FIG. 9, the shifted data elements are delayed by delay unit set 140 located behind shift 140. Similar to the delay process in the delay unit set in front of shifter 140, the shifted data elements are shifted according to the sequence of time-units such that a data element of row j at time-unit p is delayed j−1 time-units relative to the data element of row 1 at time-unit p. After the second shift, the m×n pixel data matrix is transposed and the bitplane data matrix at position $T_4$ is obtained, as shown in the figure. The bitplane data of the bitplane data matrix can be loaded into the memory cells for actuating the mirror plates of the micromirror array within the spatial light modulator.

The methods as discussed with reference to FIG. 9 and FIG. 10 can be characterized using a plurality of parameters, such as the longest path delay, the total number of flip-flops, the total number of shift-registers, the total number of multiplexers and the control signal fanout. Values of these parameters are listed in table 3 when the method and the apparatus as discussed above are employed in transposing a matrix having N columns.

TABLE 4

| Longest path delay | Number of Flipflops | Number of shift-registers | Number of multiplexers | Control fanout |
|---|---|---|---|---|
| ceil($\log_2 N$) | $N^2 - N$ | $2N - 2$ | $N\log_2 N$ | N |

Other than implementing the embodiments of the present invention in data converter 120 in FIG. 1, the embodiments of the present invention may also be implemented in a microprocessor-based programmable unit, and the like, using instructions, such as program modules, that are executed by a processor. Generally, program modules include routines, objects, components, data structures and the like that perform particular tasks or implement particular abstract data types. The term "program" includes one or more program modules. When the embodiments of the present invention are implemented in such a unit, it is preferred that the unit communicates with the controller, takes corresponding actions to signals, such as actuation signals from the controller, and inverts polarity of the voltage differences.

It will be appreciated by those skilled in the art that a new and useful method and apparatus for transposing pixel data matrices into bitplane data matrices for use in display systems having micromirror arrays have been described herein. In view of many possible embodiments to which the principles of this invention may be applied, however, it should be recognized that the embodiments described herein with respect to the drawing figures are meant to be illustrative only and should not be taken as limiting the scope of invention. For example, those of skill in the art will recognize that the illustrated embodiments can be modified in arrangement and detail without departing from the spirit of the invention. Therefore, the invention as described herein contemplates all such embodiments as may come within the scope of the following claims and equivalents thereof.

I claim:

1. A method used in a display system that comprises an array of micromirrors, each micromirror being associated with one or more memory cell of a memory cell array, to produce images, the method comprising:

loading a pixel data matrix of the image;

delivering the rows of the matrix in parallel into a data converter;

transposing, by the data converter, the pixel data matrix into a bitplane matrix following a bitplane format wherein matrix elements in one row of the matrix represent one pixel of the image; and sending the bitplane matrix into the memory cell array for actuating the micromirrors such that the image is produced by the micromirrors.

2. The method of claim 1, wherein the matrix elements in one column of the matrix represent one pixel of the image.

3. The method of claim 2, wherein the step of shifting the delayed data elements further comprises:

loading the shifted data elements at each time-unit into a register of the data converter, the register having n bits; and sequentially shifting the loaded data elements such that the data element at bit b is shifted to bit b+1, and the data element at bit n is shifted to the first bit of the register.

4. The method of claim 1, wherein the step of transposing the pixel data matrix into the bitplane matrix further comprises:

delaying the pixel data of the matrix according to a sequence of time-units such that a pixel data at column i and row j is delayed j time-units relative to the data element at column i and row 1 and one time-unit relative to the data element at column i+1 and row j;

shifting the delayed data elements at each time-unit of the sequence of time-units according to a shifting rule, wherein the shifting rule states that: for a matrix having m columns and n rows, a) the data element of row j at the $k^{th}$ time-unit of the time-unit sequence is shifted to row j−1 at the same time-unit; and the data element at row 1 of the $k^{th}$ time-unit is shifted to row m at the same time-unit, wherein k runs from 1 to m+n time-units; and b) the data elements at the $n^{th}$ and $m^{th}$ time-unit are not shifted; and delaying the shifted data elements of the matrix according to the sequence of time-units such that a pixel data of row j at time-unit p is delayed j time-units relative to the data element of row j−1 at time-unit p.

5. The method claim 1, wherein the value of the data element of the matrix determines the voltage of a memory cell of the memory cell array, and the location of the matrix element in a column of the matrix determines the duration of the voltage in the memory cell, such that the micromirror associated with said memory cell is turned on or off for the duration of said voltage.

6. The method of claim 1, wherein the step of sending the bitplane matrix into the memory cell array further comprises:

loading each row of the memory cells of the memory cell array with at least a portion of a row of data elements of the transposed pixel data matrix.

7. The method of claim 1, wherein the pixel data matrix is a square matrix having m×m data elements, wherein m equals $2^n$ and n is an integer greater than 1.

8. The method of claim 7, further comprising:

a) transforming the pixel data matrix into a block matrix having 2×2 first order blocks, each first order block having 2×2 second order blocks, each second order block having 2×2 third order blocks, each $k^{th}$ order block having 2×2 $(k+1)^{th}$ order blocks, and the $(n-1)^{th}$ order block having 2×2 pixel data elements;

b) transposing the pixel data matrix based on the first order blocks;

c) transposing the pixel data matrix based on the $k^{th}$ order blocks after consecutive transposes of the pixel data matrix based on the first order block through the $(k-1)^{th}$ order blocks; and d) transposing the pixel data matrix based on the $(n-1)^{th}$ order blocks, each of which has 2×2 pixel data elements.

9. The method of claim 7, further comprising:

a) transforming the pixel data matrix into a block matrix having 2×2 first order blocks, each first order block having 2×2 second order blocks, each second order block having 2×2 third order blocks, each $k^{th}$ order block having 2×2 $(k+1)^{th}$ order blocks, and the $(n-1)^{th}$ order block having 2×2 pixel data elements;

b) transposing the pixel data matrix based on the $(n-1)^{th}$ order blocks, each of which has 2×2 pixel data elements;

c) transposing the pixel data matrix based on the $k^{th}$ order blocks after consecutively transposes of the pixel data matrix based on the $(n-1)^{th}$ order block through the $(k+^{1})^{th}$ order blocks; and d) transposing the pixel data matrix based on the first order blocks.

10. The method of claim 9, wherein the step of transposing the pixel data matrix based on the $(n-1)^{th}$ order blocks, each of which has 2×2 pixel data elements, further comprises:

for each $(n-1)^{th}$ order block having 2×2 pixel data elements, delaying the data elements in the second row of the block one time-unit relative to the data elements in the first row of the block, and the data elements in the first column in each row one time-unit relative to the data elements in the second column of the same row;

shifting the delayed data elements at each time-unit;

delaying the shifted data elements in the first row of the block one time-unit relative to the data elements in the second row of the block.

11. The method of claim 9, wherein the step of transposing the pixel data matrix based on the first order block further comprises:

delaying the data elements of the matrix according to a sequence of time-units such that: a) data elements of rows 1 through n/2 are not delayed; b) for data elements of rows from n/2+1 through n, data elements at column i and row j is delayed one time-units relative to the data element at column i+1 and row j, and is delayed n/2 time-units relative to the data element at the same column and the first row;

shifting the delayed data elements according to a shifting rule, wherein the shifting rule states that: at each time-unit, a) exchanging the data element of row 1 with the data element of row (n/2+1) at the time-unit; and b) exchanging the data element of row i with the data element of row (n/2+i); and delaying the shifted data elements according to the sequence of time-units such that: a) data elements of rows n/2+1 through n are not delayed; b) for data elements of rows from 1 through n/2, data elements at column i and row j is delayed one time-units relative to the data element at column i+1 and row j, and is delayed n/2 time-units relative to the data element at the same column and the first row.

12. The method of claim 1, wherein the pixel data matrix having m×n data elements and wherein m is larger than n; and wherein the step of transposing further comprises:

appending (m−n) rows to the matrix, wherein each appended row has m elements; and after transposing the matrix with the appended rows, truncating (m−n) data elements from each row of the transposed matrix.

13. The method of claim 1, wherein the pixel data matrix having m×n data elements and wherein m is smaller than n; and wherein the step of transposing further comprises:

appending (m−n) data elements to each row of the matrix; and after transposing the matrix with the appended rows, truncating (m−n) rows from the transposed matrix.

14. The method of claim 1, wherein the pixel data matrix is a square matrix having m×m data elements, wherein m is an integer greater than 1.

15. A method used in a display system that comprises an array of micromirrors, each micromirror being associated with a memory cell of a memory cell array, to produce images, the method comprising:

delivering a pixel data matrix of the image to a data converter such that the rows of the pixel data matrix are delivered in parallel into the data converter, wherein the pixel data matrix following a pixel data format;

delaying the data elements of the matrix according to a sequence of time-units such that a pixel data at column i and row j is delayed j time-units relative to the data at column i and the first row and one time-unit relative to the data element at column i+1 and row j;

shifting the delayed data elements at each time-unit of the sequence of time-units according to a shifting rule, wherein the shifting rule states that: for a matrix having m columns and n rows, a) the data element of row j at the $k^{th}$ time-unit of the time-unit sequence is shifted to row j−1 at the same time-unit; and the data element at the first row of the $k^{th}$ time-unit is shifted to row m at the same time-unit, wherein k runs from 1 to m+n time-units; and b) the data elements at the $n^{th}$ and $M^{th}$ time-units are not shifted; and delaying the shifted data elements according to the sequence of time-units such that a data element of row j at time-unit p is delayed j time-units relative to the data element of row j−1 at time-unit p.

16. The method of claim 15, wherein the pixel data matrix is a rectangular matrix.

17. The method of claim 15, further comprises:

sending the shifted and delayed data matrix into the memory cell array for actuating the micromirrors for producing the image.

18. The method of claim 17, wherein the value of the data element of the matrix determines the voltage of a memory cell of the memory cell array, and the location of the data element at the matrix determines the duration of the voltage in the memory cell, such that the micromirror associated with said memory cell is turned on or off for the duration of said voltage in said memory cell.

19. A method used in a display system that comprises an array of micromirrors, each micromirror being associated with a memory cell of a memory cell array, to produce images, the method comprising:

delivering a pixel data matrix of the image to a data converter such that the rows of the pixel data matrix are delivered in parallel into the data converter, wherein the pixel data matrix following a pixel data format;

transforming the pixel data matrix into a block matrix having 2×2 first order blocks, each first order block having 2×2 second order blocks, each second order block having 2×2 third order blocks, each $k^{th}$ order block having 2×2 $(k+1)^{th}$ order blocks, and the $(n-1)^{th}$ order block having 2×2 pixel data elements;

transposing the pixel data matrix based on the $(n-1)^{th}$ order blocks, each of which has 2×2 pixel data elements;

transposing the pixel data matrix based on the $k^{th}$ order blocks after consecutively transposes of the pixel data matrix based on the $(n-1)^{th}$ order block through the $(k+1)^{th}$ order blocks; and transposing the pixel data matrix based on the first order blocks.

20. The method of claim 19, wherein the step of transposing the pixel data matrix based on the $(n-1)^{th}$ order blocks, each of which has 2×2 pixel data elements, further comprises:

for each $(n-1)^{th}$ order block having 2×2 pixel data elements, delaying the data elements in the second row of the block one time-unit relative to the data elements in the first row of the block, and the data elements in the first column in each row one time-unit relative to the data elements in the second column of the same row;

shifting the delayed data elements at each time-unit;

delaying the shifted data elements in the first row of the block one time-unit relative to the data elements in the second row of the block.

21. The method of claim 19, wherein the step of transposing the pixel data matrix based on the first order block further comprises:

delaying the data elements of the matrix according to a sequence of time-units such that: a) data elements of rows 1 through n/2 are not delayed; b) for data elements of rows from n/2+1 through n, data elements at column i and row j is delayed one time-units relative to the data element at column i+1 and row j, and is delayed n/2 time-units relative to the data element at the same column and the first row;

shifting the delayed data elements according to a shifting rule, wherein the shifting rule states that: at each time-unit, a) exchanging the data element of row 1 with the data element of row (n/2+1) at the time-unit; and b) exchanging the data element of row i with the data element of row (n/2+i); and delaying the shifted data elements according to the sequence of time-units such that: a) data elements of rows n/2+1 through n are not delayed; b) for data elements of rows from 1 through n/2, data elements at column i and row j is delayed one time-units relative to the data element at column i+1 and row j, and is delayed n/2 time-units relative to the data element at the same column and the first row.

22. The method of claim 19, wherein the pixel data matrix having m×n data elements and wherein m is larger than n; and wherein the step of transposing further comprises:

appending (m−n) rows to the matrix, wherein each appended row has m elements; and after transposing the matrix with the appended rows, truncating (m−n) data elements from each row of the transposed matrix.

23. The method of claim 19, wherein the pixel data matrix having m×n data elements and wherein m is smaller than n; and wherein the step of transposing further comprises:

appending (m−n) data elements to each row of the matrix; and after transposing the matrix with the appended rows, truncating (m−n) rows from the transposed matrix.

24. The method of claim 19, wherein the pixel data matrix is a square matrix having m×m data elements, wherein m is an integer greater than 1.

25. The method of claim 19, wherein the pixel data matrix is a square matrix having $2^n$ columns and $2^n$ rows of data elements.

26. An apparatus used in a display system that comprises an array of micromirrors, each micromirror being associated a memory cell of a memory cell array to produce images, the apparatus comprising:

a plurality of input lines that are associated with a sequence of time-units, each input line being designated for receiving a row of data elements of a pixel data matrix;

a delay unit connected to the plurality of input lines, wherein the delay unit delays the received data such that: a) a data element at input line j at time-unit k is delayed one time-unit relative to the data element at input line j at time-unit k+1; and b) the data element is delayed one time-unit relative to the data element at input line j−1 at time-unit k; and a shifter connected to and receiving output data from the delay unit, wherein the shifter shifts the delayed data output from the first delay unit based on the sequence of time-units and according to a shifting rule, wherein the shifting rule states that:

a) the data element of line j at the $k^{th}$ time-unit is shifted to line j−1 at the same time-unit; and the data element at line 1 at the $k^{th}$ time-unit is shifted to row m at the same time-unit, wherein k runs from 1 to m+n time-units; and b) the data elements at the $n^{th}$ and $m^{th}$, time-unit are not shifted.

27. The apparatus of claim 26, further comprises:

a shift register for shifting data elements at one time-unit.

28. The apparatus of claim 26, wherein the delay unit is a standard flip-flop.

29. The apparatus of claim 26, wherein the delay unit is an aka shift register.

30. The apparatus of claim 26, wherein the number of data bits in each delay equals the number of data elements in the pixel matrix.

31. The apparatus of claim 26, wherein shift rule states that: the data element in the first row of the pixel data matrix, and the data element in the last row of the pixel matrix are not transposed thereby; and the data element between the first column and the last column of the pixel data matrix are to be permuted.

32. The apparatus of claim 26, wherein the input lines are connected to a plurality of input signals.

33. The apparatus of claim 32, wherein the input signals are data elements of a pixel data matrix.

34. The apparatus of claim 33, wherein the pixel data elements of the pixel data matrix is stored in a frame buffer to be loaded into a memory cell array.

35. The apparatus of claim 34, wherein the memory cell is a charge-pump-memory cell that further comprises:

a transistor having a source, a gate, and a drain;

a storage capacitor having a first plate and a second plate; and wherein the source of said transistor is connected to a bitline, the gate of said transistor is connected to a wordline, and wherein the drain of the transistor is connected to the first plate of said storage capacitor forming a storage node, and wherein the second plate of said storage capacitor is connected to a pump signal.

36. The apparatus of claim 34, wherein the memory cell is a standard DRAM circuit.

37. The apparatus of claim 34, wherein the memory cell is a SRAM circuit.

38. The apparatus of claim 34, wherein each memory cell is connected to an addressing electrode.

39. The apparatus of claim 34, wherein the addressing electrode is associated with a mirror plate of the micromirror such that an electrostatic field is established between the mirror plate and the electrode.

40. The apparatus of claim 34, wherein the electrostatic field drives the mirror plate to rotate relative to the substrate.

41. An apparatus used in a display system that comprises an array of micromirrors, each micromirror being associated a memory cell of a memory cell array to produce images, the apparatus comprising:

a plurality of input lines that are associated with a sequence of time-units, each input line being designated for receiving a row of data elements of a pixel data matrix having m columns and n rows;

a multiplicity of sets of delay units, a) wherein a delay unit of the first set of delay units delays a data element one time-unit, and the delay units of the first set are connected to every two input lines, and b) wherein a delay unit of the $s^{th}$ set of delay unit delays a data $2^{s-1}$ time-units, and the delay units of the $s^{th}$ set are connected to every $2^{s-1}$ input lines;

a plurality of sets of switches, a) wherein a switch of the first set of switches exchanges data elements between input lines 2w−1 and 2w with s running from 1 to n/2; and b) wherein a switch of the $s^{th}$ set of switches exchanges data elements between 2w−1 and (n/2)+s; and wherein each switch of the $s^{th}$ set of switches are located between and connected to two delay units of the $s^{th}$ set of delay units.

42. The apparatus of claim 41, further comprising:

a shift register for shifting data elements at a time-unit.

43. An apparatus used in a display system that comprises an array of micromirrors for producing an image, the apparatus comprising:

a first input line and a second input line that are associated with a sequence of time-units for receiving data elements;

a first delay unit that is connected to the second input line and delays the received data element one time-unit;

a switch that is connected to the first input line and the first delay unit and receives data element from the output of the first delay unit, wherein the switch switches data elements between the first input line and the delayed data element output from the first delay unit; and a second delay unit that is connected to the first input line and delays the received data element one time-unit.

44. The apparatus of claim 43, wherein the value of the data element determines the voltage of a memory cell of the memory cell array, and the time the data being received by the input line is associated with the duration of the voltage in the memory cell.

45. The apparatus of claim 44, wherein the memory cell is a standard SDRAM.

46. The apparatus of claim 44, wherein the memory cell is a charge-pump-memory-cell that further comprises:

a transistor having a source, a gate, and a drain;

a storage capacitor having a first plate and a second plate; and wherein the source of said transistor is connected to a bitline, the gate of said transistor is connected to a wordline, and wherein the drain of the transistor is connected to the first plate of said storage capacitor forming a storage node, and wherein the second plate of said storage capacitor is connected to a pump signal.

47. The apparatus of claim 44, wherein the memory cell is part of a micromirror that further comprises a movable mirror plate.

48. The apparatus of claim 47, wherein the mirror plate is movable in response to an electrostatic field established between the mirror plate and an electrode that is connected to the memory cell, wherein the strength of the electrostatic field is determined by the voltage of the memory cell.

49. The apparatus of claim 48, wherein the micromirror represents a pixel of an image.

50. The apparatus of claim 43, further comprising:

a first output line that is connected to and receives output data from the second delay unit, and a second output line that is connected to the second input line; and wherein the first output line and the second output line output data element to the memory cell of the memory cell array for actuating the micromirrors of the micromirror array.

51. The apparatus of claim 43, further comprising:

a shift register for shifting data at a time-unit.

52. The apparatus of claim 51, further comprising: a frame buffer for storing the output data from the output lines.

53. The apparatus of claim 52, further comprising: a data processor that receives a stream of analog signals of an image and outputs a stream of pixel data corresponding to the stream of analog signals of the image.

54. The apparatus of claim 43, wherein each time unit of the sequence of time units is a clock cycle of the display system.

55. The apparatus of claim 43, wherein each time unit of the sequence of time units is a clock cycle of the display system.

56. The apparatus of claim 43, wherein the delay unit is a standard flipflop circuit.

57. The apparatus of claim 43, wherein the delay is a register.

58. The apparatus of claim 43, wherein the switch comprises a multiplexer.

59. The apparatus of claim 58, wherein the multiplexer is connected to and controlled by a control signal.

60. The apparatus of claim 59, wherein the control signal is associated with the sequence of time unit.

* * * * *